US007828624B2

(12) United States Patent
Siders et al.

(10) Patent No.: US 7,828,624 B2
(45) **Date of Patent: *Nov. 9, 2010**

(54) METHOD OF LOCAL MANUFACTURE OF OPHTHALMIC LENS USING REMOTELY ASSEMBLED PRE-BLOCKED LENS BLANKS

(75) Inventors: Larry K. Siders, Wooster, OH (US); Donald F. Baechtel, Lyndhurst, OH (US)

(73) Assignee: NCRX Optical Solutions, Inc., Medina, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/838,867

(22) Filed: Aug. 14, 2007

(65) Prior Publication Data

US 2008/0026679 A1 Jan. 31, 2008

Related U.S. Application Data

(60) Continuation-in-part of application No. 11/553,708, filed on Oct. 27, 2006, now Pat. No. 7,371,154, which is a continuation-in-part of application No. 11/279,092, filed on Apr. 7, 2006, now Pat. No. 7,128,638, which is a division of application No. 11/191,422, filed on Jul. 27, 2005, now Pat. No. 7,086,928, which is a division of application No. 10/420,023, filed on Apr. 21, 2003, now Pat. No. 6,953,381, which is a division of application No. 09/760,623, filed on Jan. 16, 2001, now Pat. No. 6,568,990.

(60) Provisional application No. 60/822,282, filed on Aug. 14, 2006, provisional application No. 60/176,658, filed on Jan. 18, 2000.

(51) Int. Cl.
*B24B 49/00* (2006.01)

(52) U.S. Cl. ..... 451/5; 451/43

(58) Field of Classification Search ..... 451/5, 451/41, 43
See application file for complete search history.

(56) References Cited

U.S. PATENT DOCUMENTS

| | | | | |
|---|---|---|---|---|
| 4,677,729 | A * | 7/1987 | Morland et al. | 29/426.5 |
| 5,505,654 | A * | 4/1996 | Wood et al. | 451/6 |
| 5,588,899 | A * | 12/1996 | Gottschald | 451/5 |
| 5,648,025 | A * | 7/1997 | Cook et al. | 264/1.36 |
| 6,012,965 | A * | 1/2000 | Savoie | 451/6 |
| 6,568,990 | B2 * | 5/2003 | Siders et al. | 451/5 |
| 6,890,241 | B2 * | 5/2005 | Kozakai et al. | 451/5 |
| 7,150,528 | B2 * | 12/2006 | Zaiser | 351/177 |

(Continued)

FOREIGN PATENT DOCUMENTS

GB 2230983 A * 11/1990

*Primary Examiner*—David B Thomas
(74) *Attorney, Agent, or Firm*—Blynn L. Shideler; Krisanne Shideler; BLK Law Group

(57) ABSTRACT

A method of manufacturing ophthalmic lenses comprises the steps of: a) mounting lens blanks on lens blocks at a blocking location; b) transporting the blocked lens blanks to at least one manufacturing site that is remote from the blocking location; and c) selectively machining ophthalmic lens from the blocked lens blanks at the manufacturing site on a machining platform, wherein the selective machining of ophthalmic lens includes back surface generation of the lens blanks and edging of the lens blanks at the manufacturing site on a single manufacturing platform.

14 Claims, 21 Drawing Sheets

U.S. PATENT DOCUMENTS 7,306,334 B2 * 12/2007 Zaiser ..... 351/178
7,371,154 B2 * 5/2008 Siders et al. ..... 451/41
2003/0004857 A1 * 1/2003 Brown et al. ..... 705/37
2003/0157869 A1 * 8/2003 Luderich et al. ..... 451/240
2004/0235397 A1 * 11/2004 Lack ..... 451/41

* cited by examiner

Feed Angle = 2 * ArcCos $(c^2 + a^2 - b^2) / 2ac$ a = (lens radius – tool radius)
b = tool radius
c = (lens radius – Ra)

Note: use shortest radius of a toric lens

SECTION B-B

METHOD OF LOCAL MANUFACTURE OF OPHTHALMIC LENS USING REMOTELY ASSEMBLED PRE-BLOCKED LENS BLANKS

RELATED APPLICATIONS

The present application claims the benefit of provisional patent application Ser. No. 60/822,282 filed Aug. 14, 2006 entitled "System and Method for Ophthalmic Lens Manufacture."

This application is a continuation-in-part of U.S. patent application Ser. No. 11/553,708 entitled "Dual Ophthalmic Lens Machining Platform and Simultaneous Ophthalmic Lens Manufacturing Method". U.S. patent application Ser. No. 11/553,708 published as U.S. patent application publication number 2007-0167112 on Jul. 19, 2007.

U.S. patent application Ser. No. 11/553,708 is a continuation-in-part of U.S. patent application Ser. No. 11/279,092 entitled "System and Method for Ophthalmic Lens Manufacture" filed on Apr. 7, 2006. U.S. patent application Ser. No. 11/279,092 published as U.S. patent application publication number 2006-0166609 on Jul. 27, 2006 and is now U.S. Pat. No. 7,128,638 which issued Oct. 31, 2006.

U.S. patent application Ser. No. 11/279,092 is a division of U.S. patent application Ser. No. 11/191,422 entitled "System and Method for Ophthalmic Lens Manufacture" filed on Jul. 27, 2005. U.S. patent application Ser. No. 11/191,422 published as U.S. patent application publication number 2005-0266772 on Dec. 1, 2005 and is now U.S. Pat. No. 7,086,928 which issued Aug. 8, 2006.

U.S. patent application Ser. No. 11/191,422 is a division of U.S. patent application Ser. No. 10/420,023 entitled "System and Method for Ophthalmic Lens Manufacture" filed on Apr. 21, 2003. U.S. patent application Ser. No. 10/420,023 published as U.S. patent application publication number 2003-0181133 on Sep. 25, 2003 and is now U.S. Pat. No. 6,953,381 which issued Oct. 11, 2005.

U.S. patent application Ser. No. 10/420,023 is a division of U.S. patent application Ser. No. 09/760,623 entitled "System and Method for Ophthalmic Lens Manufacture" filed on Jan. 16, 2001. U.S. patent application Ser. No. 09/760,623 published as U.S. patent application publication number 2001-0051490 on Dec. 13, 2001 and is now U.S. Pat. No. 6,568,990 which issued May 27, 2003.

U.S. patent application Ser. No. 09/760,623 claims the benefit of U.S. provisional patent application Ser. No. 60/176,658 entitled "System and Method for Ophthalmic Lens Manufacture" filed on Jan. 18, 2000. This application hereby incorporates by reference the above identified United States patent application publications and United States patents, in their entirety.

BACKGROUND

1. Field of the Invention

This invention relates to the manufacture of ophthalmic lenses. Specifically this invention relates to a new method for manufacturing ophthalmic lenses using pre-blocked lens blanks.

2. Background of the Invention

Ophthalmic lens manufacturing typically requires many steps and many devices and machines operated by well trained technicians. For example, lens generation typically involves a skilled technician mounting a lens blank on a block responsive to a desired prescription for the finished lens. The technician then uses one machine that performs surfacing on the lens blank and a second machine for fining and/or polishing with a lap tool. Operation of these machines produces finished uncut lenses that then need to be deblocked and marked-up and reblocked again for edging on yet another machine. Each of these steps requires expensive skilled operator intervention. Each machine used in the process requires lab space and has associated acquisition and maintenance costs. Therefore, there is a need for a method of ophthalmic lens manufacture that may eliminate or reduce the amount of skilled labor required and there is a need for a method of ophthalmic lens manufacture that may reduce the number of machines or devices required to produce ophthalmic lenses.

SUMMARY OF THE INVENTION

It is noted that, as used in this specification and the appended claims, the singular forms "a," "an," and "the" include plural referents unless expressly and unequivocally limited to one referent.

For the purposes of this specification, unless otherwise indicated, all numbers expressing parameters used in the specification and claims are to be understood as being modified in all instances by the term "about." Accordingly, unless indicated to the contrary, the numerical parameters set forth in the following specification and attached claims are approximations that may vary depending upon the desired properties to be obtained by the present invention. All numerical ranges herein include all numerical values and ranges of all numerical values within the recited numerical ranges. The various embodiments and examples of the present invention as presented herein are each understood to be non-limiting with respect to the scope of the invention.

It is a further object of an exemplary embodiment to provide systems and methods for ophthalmic lens manufacture which may eliminate or reduce the amount of skilled labor required to produce ophthalmic lenses from lens blanks and which may reduce the number of machines or devices required to fabricate ophthalmic lenses from lens blanks.

The foregoing objects may be accomplished in one exemplary embodiment by a system and method for ophthalmic lens manufacture that employs computer numerically controlled (CNC) machining techniques that are operative to generate and edge semi-finished lenses and to edge finished uncut lenses. Examples of systems and methods for ophthalmic lens manufacture which may be used in exemplary embodiments are described in U.S. Pat. Nos. 7,128,638; 7,086,928; 6,953,381; and 6,568,990, and U.S. published application nos. 2007-0167112; 2006-0166609; 2005-0266772; 2003-0181133 and 2001-0051490 which are hereby incorporated herein by reference in their entireties.

In an exemplary embodiment, the method of blocking may be used that is independent of the frame data and prescription specifications. In such an embodiment, the lens blank may be pre-blocked for use with both surfacing and edging. The term "Pre-blocked" or "pre-blocking" within this specification is the blocking of a lens blank prior to specific prescription and/or frame being associated with the lens. Therefore, such pre-blocking would be carried out without regard to lens prescription variables and frame size and shape variables. Pre-blocking in this manner eliminates the need to wait for the presentation of lens prescription and frame variables before a lens blank is blocked and eliminates the time required to allow for cooling of blocking media. As a result, use of pre-blocked lens blanks may significantly reduce the amount of time it takes to produce finished and edged lenses. Further, with such pre-blocking the blocking job can be efficiently separated from the machining oversight job, and such can be performed by different personnel, even at different locations.

In these described exemplary embodiments, the block preparation may be accomplished by forming (such as by machining or molding) the block with a shape that is complimentary to the shape of the front surface of the lens blank when positioned on the block such that the a direction normal to a front surface of the lens blank at the geometric center of the finished lens that will be machined from the lens blank to fit within a lens receiving portion of a spectacle frame is parallel with the axis of rotation of the block on the machining platform. As used herein parallel directions, axes and/or lines include directions axes and/or line which are coincident.

In further exemplary embodiments the block may be formed (such as by molding or machining) to receive the lens blank in an orientation in which a direction normal to a front surface of the lens blank at a geometric center of the finished lens that will be machined from the lens blank to fit within a lens receiving portion of a spectacle frame is about parallel to a relative feed axis of a machining tool when the block is affixed to a machining platform.

As used herein, these described methods of blocking a lens blank are referred to as geometric center blocking. In addition, in further exemplary embodiments, the block may be formed to receive finished uncut lens blanks in an orientation in which a direction normal to a front surface of the lens blank at its geometric center coincides with the geometric center of the block.

For blocks that are machined, the block preparation may further include machining scribe markings onto the surface of the block that correspond to lens front surface landmarks, center location markings, or factory makings. These scribe marks may then be used to facilitate the proper positioning of the lens blank relative to the block coordinates. The lens markings may be visually aligned by an operator to the scribe marks on the block and then the lens blank may be adhesively affixed to the lens block. Once the lens blank is mounted to the machined block in this manner all points on the front surface of the lens blank can be determined relative the reference frame of the block and the machining platform.

In an exemplary embodiment a rotary cutting tool on a rotating spindle may be used to perform rough cutting of the back surface and to edge the lens blank to correspond to the lens receiving portion of the spectacle frame. A corresponding lap tool may then be used to fine and polish the back surface to produce a finished optical surface. In an exemplary embodiment the lap tool may be machined to correspond to the geometry of the back surface of the lens using the machining platform. The machine platform may be operative to generate the lap tool responsive to the front surface data, prescription specifications of the machined lens that will be fined and polished with the finished lap tool, the frame data in some cases, and the thicknesses of the fining and polishing pads.

A special note should be made of the fact that geometric center blocking of a lens blank as described previously is operative to optimally block a lens for edging but often may not optimally block the lens for surfacing. A lens so blocked will frequently experience unwanted drifting of the optical center as the lens is reduced in thickness during the fining process with a lap tool. In an exemplary embodiment this optical center drift effect may be pre-calculated assuming a known thickness of material removal during the fining process. This pre-calculation may then be used to compensate for the optical center position drift. The desired optical center position may then be obtained by controlling the amount of material removed during the fining process to conform to the amount used in the calculation.

In an alternative exemplary embodiment, a rotary cutting tool on a rotating spindle may be used to perform rough cutting of the back surface to within approximately 250 to 500 microns of the desired optical surface. During this rotary stage operation the same rotary cutting tool may also be used to crib the lens diameter down to a size or to otherwise modify the shape of the lens blank appropriate for minimal surfacing effort. Further in this rotary stage the same rotary cutting tool may further be used to pin bevel the lens blank after cribbing and surface generation.

With the lens still mounted on the machining platform, fine finish surfacing may be performed by lathing of the lens surfaces with a diamond tool or any other appropriate tool. This lathing stage may create a lens back surface that is sufficiently close to the final lens surface for all points on the lens back surface and having a surface roughness (Rz of Ra) fine enough to allow for bringing the surface to optical quality by either one or two polishing steps or fine enough to allow for bringing the surface to optical quality by a coating process, or fine enough to allow for bringing the surface to optical quality by either one or two polishing steps followed by a coating process. Pin beveling may also be accomplished at this stage. Alternately, a rough pin beveling may be executed on the rotary stage and then a fine pin bevel, for extra smoothness, may be executed by the lathing stage.

Because the back surface has been lathed to a very close approximation of the final lens surface, a conformable lap or soft-lap polishing may be performed on the lens rather then using a specific rigid lap tool. With the lens still mounted on the machining platform, moistened polish impregnated soft lap tools may be pressed against the lens back surfaces and may be made to oscillate against the lens surfaces while the lenses are rotated and dithered relative to the oscillating lapping surfaces. The combination of lap oscillation with lens rotation and dithering produces the required randomness in lens to lap opposition during the polishing step. As an alternative to using polish impregnated lapping surfaces, the lap-lens interface may be bathed in recirculating polishing slurry. The polishing slurry may be chilled. Alternately, polishing gels or pastes could be introduced into the lens-lap interface for polishing.

In this described alternative exemplary embodiment, because the polishing process may only remove less than 5 microns of material, the optical center drift during the polishing process may be negligible. As a result it may not be necessary to account for the optical center drift in the calculations of the tool paths during back surface generation by the machining platform.

The diamond tool used during the lathing stage may have a spherical tip with a radius of 6 nun for example. With geometric center blocking of a lens as described herein, the back surfaces are often tilted relative to the axis of rotation of the lens blank. Unfortunately, when using a diamond tool as described, the tool may dwell over the center of rotation of the lens blank, and as a result the tip of the tool may not stay in contact with the center of the lens surface at the center of rotation. Also, a tool tip dwelling over the center, may remove material that should not be removed. As a result standard spiraling in lathing of the surface may produce undesirable artifacts near the lens center when the back surface is tilted sufficiently. Similar problems may exist when using a rotary milling head for surfacing. In an exemplary embodiment, these artifacts may be reduced by calculating tool paths which achieve spiral passes that are spaced at equal angles from the center of the surface. Further tool paths may be calculated which cause the tool tip to pass the center line of the lens by a very precise amount, at which point the tool tip is lifted from the surface at precisely the right position and orientation in order to avoid placing undesirable machining artifacts onto the lens surface.

After the polishing step is completed, the lens may be moved back to the rotary stage for edging. In an alternative exemplary embodiment, the edging may be performed during the lathing stage. If safety beveling is required, either the rotary stages or lathing stages or both could be used to perform the safety beveling. The edging step may also precede the polishing step. Also, the machinable block will have material removed from its mass during the cribbing and edging steps and may or may not be cut into during the surface roughing step.

A special case should be noted for lenses having spherical front surfaces. Optimizing the blocking of spherical front surface lens blanks for edging may be performed without being responsive to a prescription or the lens receiving dimensions of the intended spectacle frame. As a result, spherical front surface lenses may be blocked such that when mounted in the machining platform, any radius of the spherical front surface of the lens blank that intersects the front surface of the blank at a position that will allow for the lens to "cut out" during edging is parallel to the relative feed axis of the cutting tool and/or is about parallel to the axis of rotation of the lens blank and block. As used herein and in the art of making ophthalmic lens, the term "cut out" describes the condition where the lens blank is large enough or positioned in such a way during blocking so that the lens being formed is able to cover the entire area of the desired final lens dimensions after edging. As a result the formed lens will have a size and shape of the frame without any voids near the edge of the lens caused by the lens not "cutting out".

Because all spherical front surface lenses may be blocked in this same manner regardless of prescription of frame variations, an exemplary embodiment may include a method by which spherical front surface lens blanks are pre-blocked in this described manner prior to being mounted to a machining platform. As discussed previously, pre-blocking may be carried out without regard to frame or prescription variables. In addition, such pre-blocking may be performed during the manufacturer of the lens blanks. In exemplary embodiments, the blocks used for pre-blocking the spherical front surface lens blanks may include standardized adapters that are operative to enable the blocks to be preciously and rigidly mounted to a machining platform so that the coordinates of the front surface of the lens blank may be accurately calculated in the coordinate system of the machining platform.

When prescription lenses are to be generated at a lab, a technician may insert a pre-blocked special front surface lens into the chuck or other mounting device of the machining platform. In addition, the exemplary embodiment may further include auto-loading of these pre-blocked spherical front surface lens blank and as a result may remove the operator intervention now required to block and mount lens blanks onto machining platforms for making ophthalmic lenses.

In this described exemplary embodiment the pre-blocked lenses may be affixed to the blocks with far greater adhesive strength than provided by blocking compounds such as molten waxes and alloys, thereby allowing for more aggressive machining and reduced cycle times for producing lenses. Examples of adhesives with higher adhesive strength which may be used for pre-blocking spherical front surface lens blanks may include: epoxy-resin combinations, cyanoacrylates, thermoplastic compounds, thermosetting compounds, light activated adhesives, polymerizing compounds, auto-polymerizing compounds, or suitable metallic alloys.

In exemplary embodiments, deblocking of the machined lens from the block may be accomplished by a destructive process in which the machinable block may be split into at least 2 sections using a wedge applied to points of engineered vulnerability within the block. The splitting of the block may release most of the adhesion at the lens-block interface thereby facilitating deblocking.

The exemplary embodiments include methods for manufacturing ophthalmic lenses from semi-finished uncut lens blanks on one machine without multiple blocking steps and without removing the lens blank work pieces from a machining platform during the manufacturing process. In exemplary embodiments of the one machining platform, the machining steps of lens manufacture of front surface spherical lenses may include the performance of back surface free form surfacing, conformable lap polishing, and lens edging without operator intervention. The machining steps involving semi-finished uncut lens blanks with irregular or non-spherical front surfaces may be performed in exemplary embodiments with minimal operator intervention. The machining steps of exemplary embodiments of the one machining platform may further include bevel edging, grooved edging, customized edging, edge notching, edge polishing, pin beveling, safety beveling, producing matte edge surfaces, lens faceting, lens engraving, and lens drilling.

As used herein, a machining platform corresponds to a system of components operative to carry out the machining processes described herein. Such a machining platform may be comprised of a collection of machining and processing devices that are integrated on a common base or housing. However such a machining platform may also be comprised of a collection of machining and processing devices that operate to carry out the described processes, but may not all be mounted to a common base or common housing.

As will be appreciated, the foregoing objects and examples are exemplary and embodiments need not meet all or any of the foregoing objects, and need not include all or any of the exemplary features described herein. Additional aspects and embodiments within the scope of the claims will be devised by those having skill in the art based on the teachings set forth herein. These and other advantages of the present invention will be described in the following description taken together with the attached figures win which like reference numeral represent like elements throughout.

DETAILED DESCRIPTION OF THE INVENTION

Figure 1:
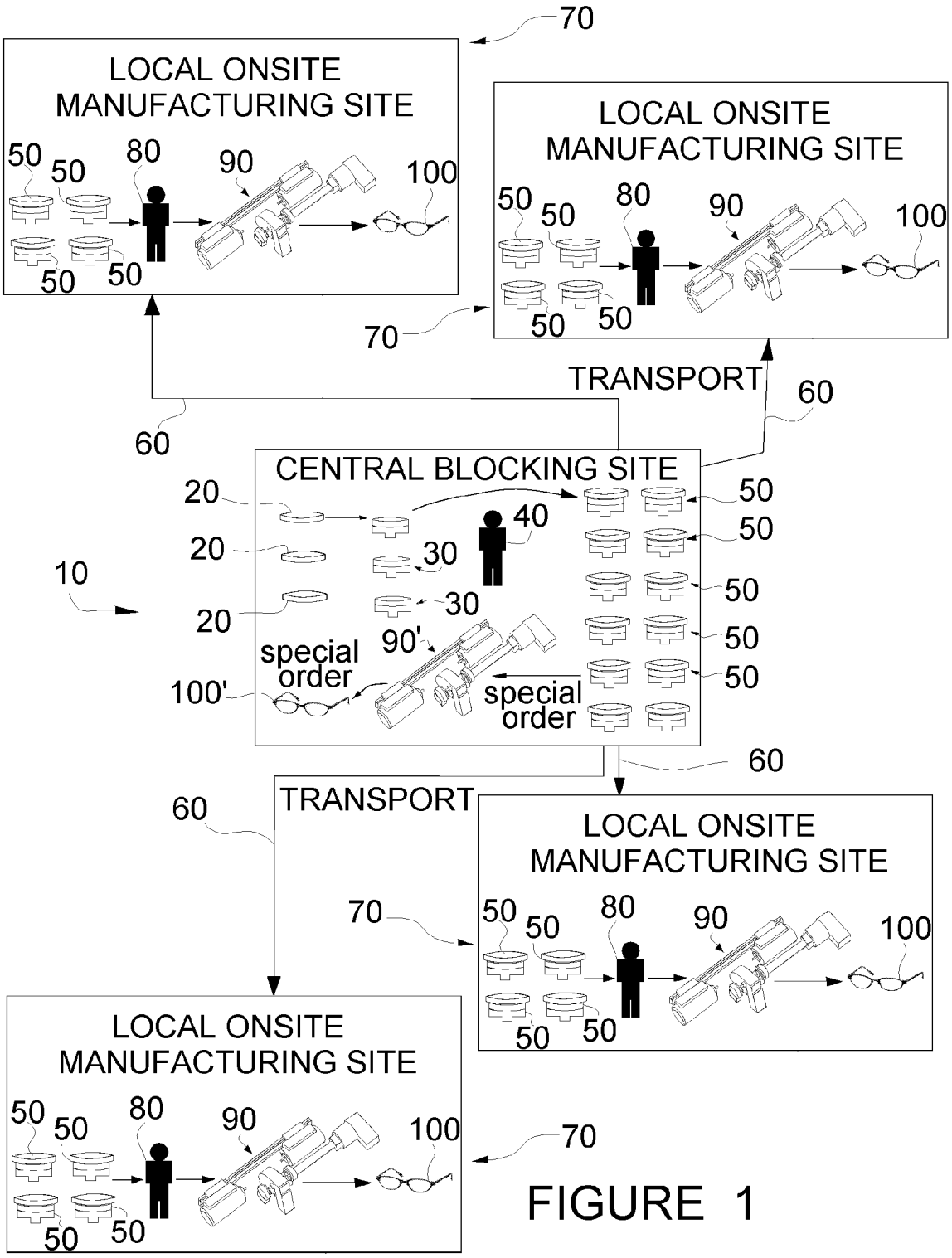
FIG. 1 is a schematic flow chart illustrating a method of local manufacturing of ophthalmic lens using remotely assembled pre-blocked lens blanks according to the present invention as described hereinafter.

FIG. 1 is a schematic flow chart illustrating a method of local manufacturing of ophthalmic lens 100 using remotely assembled pre-blocked lens blanks 50. The method of manufacturing ophthalmic lens 100 includes mounting lens blanks 20 on lens blocks 30 at a blocking location or central blocking site 10' by a blocking technician 40 without knowledge of the eyeglass prescription for the patient.

The pre-blocked lens blanks 50 are transported (60) to one or more one manufacturing sites 70 that is remote from the blocking location. The ophthalmic lens 100 are selectively machined by a machining technician 80 from the pre-blocked lens blanks 50 at the manufacturing site 70 on a machining platform 90. The selective machining of ophthalmic lens may include back surface generation of the lens blanks and edging of the lens blanks at the manufacturing site. 13. In accordance with one aspect of the present invention the machining platform 90 at each manufacturing location 70 occupies less than about fifteen square feet.

The preferential blocking techniques for the pre-blocked lenses 50 and the preferential machining platform 90 are described in U.S. Pat. Nos. 7,128,638; 7,086,928; 6,953,381; and 6,568,990, and U.S. published application nos. 2007-0167112; 2006-0166609; 2005-0266772; 2003-0181133 and 2001-0051490 which are hereby incorporated herein by reference in their entireties, as noted above.

As schematically shown in FIG. 1 the method can include selecting the pre-blocked lens blank assembly 50 responsive to the eyeglass prescription from an inventory comprised of plurality of sets of pre-blocked lens blank assemblies 50, wherein each respective set of assemblies includes lens blanks with different respective front surface topographies.

The method according to the present invention may be defined as operating at least one computer responsive to data representative of an eyeglass prescription for a patient, providing an output through an output device of the computer, which output prompts a user or machining technician 80 to select a pre-blocked lens blank assembly 50 from an inventory comprised of a plurality of sets of pre-blocked lens blank assemblies 50, wherein each pre-blocked lens blank assembly 50 is comprised of a lens blank 20 mounted to a block 30, wherein each respective set of assemblies includes lens blanks with different respective front surface topographies. Further, the method includes operating at least one computer, causing a machining platform 90 to machine the lens blank 20 of the selected pre-blocked lens blank assembly 50 responsive to data representative of the eyeglass prescription for the patient and responsive to data representative of a lens receiving portion of an eyeglass frame. One important aspect of the invention is producing the selected pre-blocked lens blank assembly 50 by mounting the lens blank 20 to the block 30, wherein mounting the lens blank 20 to the block 30 is not carried out responsive to either data representative of the eyeglass prescription of the patient or data representative of the lens receiving portion of the eyeglass frame (e.g. pre-blocking). The pre-blocked lens blank assembly 50 may be a pre-blocked finished uncut lens assembly from an inventory comprised of a plurality of sets of pre-blocked finished uncut lens assemblies, wherein each pre-blocked finished uncut lens assembly is comprised of a finished uncut lens mounted to a block, wherein each respective set of assemblies includes finished uncut lenses associated with different eyeglass prescriptions.

In the present invention during edging of the finished uncut lens, the machining platform 90 may cause an axis of rotation of the machining tool to move so as to change an angle between the axis of rotation of the machining tool and a front surface normal at a geometric center of the finished lens after being edged.

In accordance with one aspect of the present invention, the selective machining of ophthalmic lens includes simultaneously machining left and right ophthalmic lens from the blocked lens blanks at the manufacturing site on the machining platform.

In accordance with one aspect of the present invention the edging of each lens blank includes machining an edge of the lens blank to include a contour adapted to be mounted in the lens receiving portion of an eyeglass frame responsive to data representative of the lens receiving portion.

In accordance with one aspect of the present invention each lens blanks remains blocked throughout the back surface generation and the edging of the lens blanks.

In accordance with one aspect of the present invention the central blocking site 10' may include a machining platform 90' for special orders, whereby for special orders the technician 40 can mount additional lens blanks on additional lens blocks at the blocking location; and selectively machine specialized ophthalmic lens 100' from the additional blocked lens blanks at the blocking location on a machining platform 90', wherein the specialized ophthalmic lens are unsuitable to be machined from the blocked lens blanks at the manufacturing site.

In accordance with one aspect of the present invention the blocked lens blanks includes identifying indicia indicative of a species of lens that may be machined from the blocked lens blank. The identifying indicia may include a bar code, an alphanumeric printed code, color coding, and combinations thereof.

In an alternative exemplary embodiment, the machining platform may be operative to manipulate other types of tools in addition to a machining tool such as a pen or other marking device. In this alternative exemplary embodiment, the machining platform may be operative to calculate tool paths for moving the tip of the pen across the upper surface of the block to mark the block with the scribe lines or other alignment features.

Once a lens blank has been blocked, all of the spatial coordinate points (x, y, z) on the front surface of the lens blank can be determined with adequate certainty relative to the coordinate system of the machining platform when the blocked lens is mounted on the machining platform. Further the described method of blocking a lens may enable the lens blank to be blocked in specific orientations which may be optimal for fabricating lenses with certain characteristics. For example the block may be machined to receive the lens blank in an orientation that is optimal for edging. As will be described in more detail below, to optimize lens blocking for edging, the block may be machined to receive the lens blank in an orientation in which a direction normal to a front surface of the lens blank at a geometric center of a lens that will be machined from the lens blank to fit within a lens receiving portion of a spectacle frame is about parallel to either a relative feed axis of a machining tool or the axis of rotation of the block when the block is affixed to a machining platform.

An alternate exemplary embodiment of the method would provide for blocking the lens in any manner optimal for surfacing, and then placing an optimal edge contour upon the lens edge by a sculpting process in a lathing operation using an appropriately configured single point lathing tool.

Figure 2:
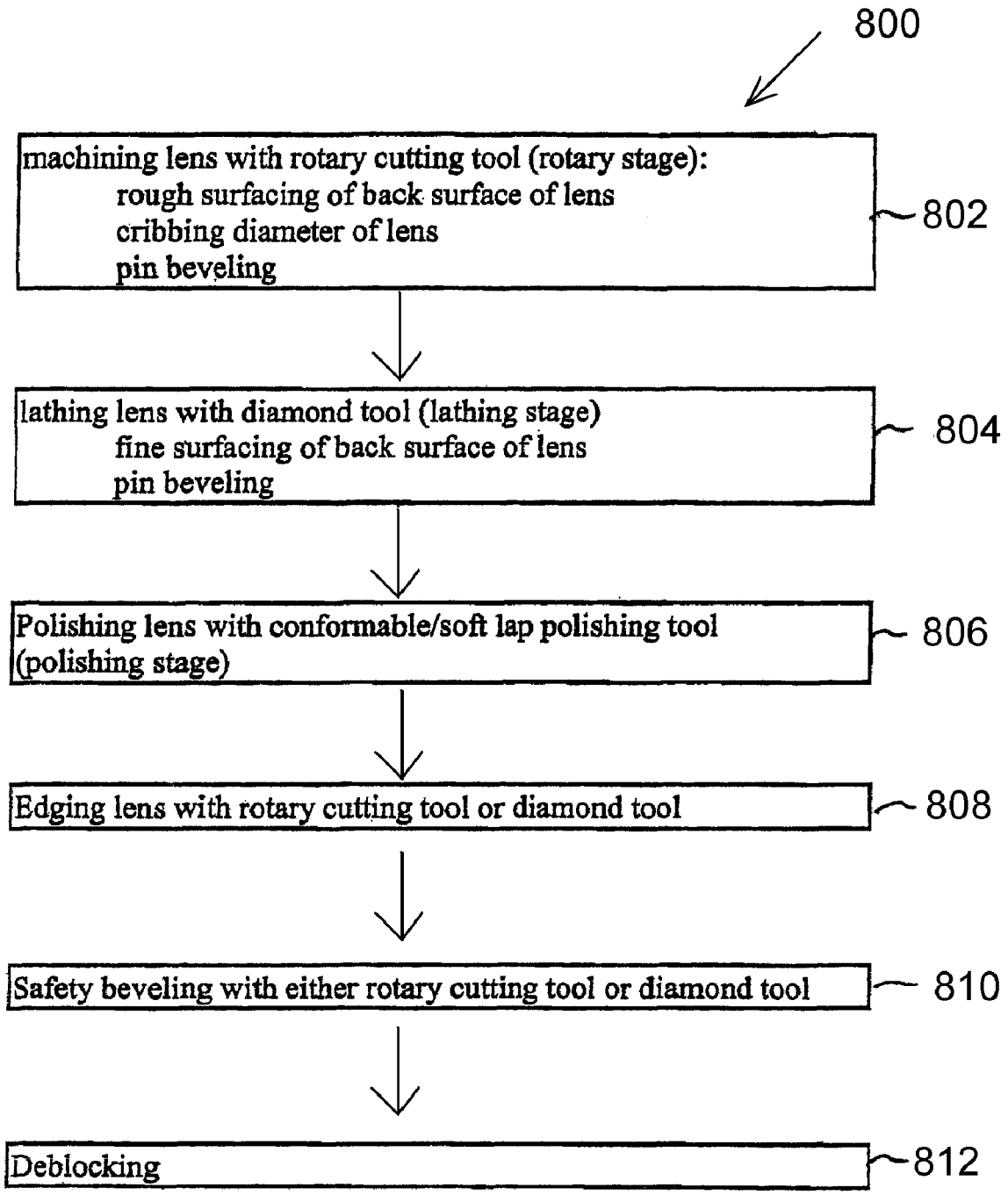
FIG. 2 shows an alternative exemplary embodiment of method steps for generating an ophthalmic lens from a lens blank.

FIG. 2 shows an alternative exemplary embodiment of a method 800 for machining the lens blank which begins after the lens blank has been blocked and mounted to a machining platform. Here the method may include a machining step 802 involving a rotary stage using a rotary cutting tool. In the exemplary embodiment, the rotary stage machining step may include rough surface cutting of the back surface to within approximately 250 to 500 microns of the desired optical surface using a rotary cutting tool. The rotary cutting tool may also be used to crib the lens diameter down to a size which reduces the amount of material needed to be removed during the rough surfacing of the back surface of the lens. Also during this step, the same rotary cutting tool may further be used to pin bevel the lens after cribbing and surface generation.

Figure 3:
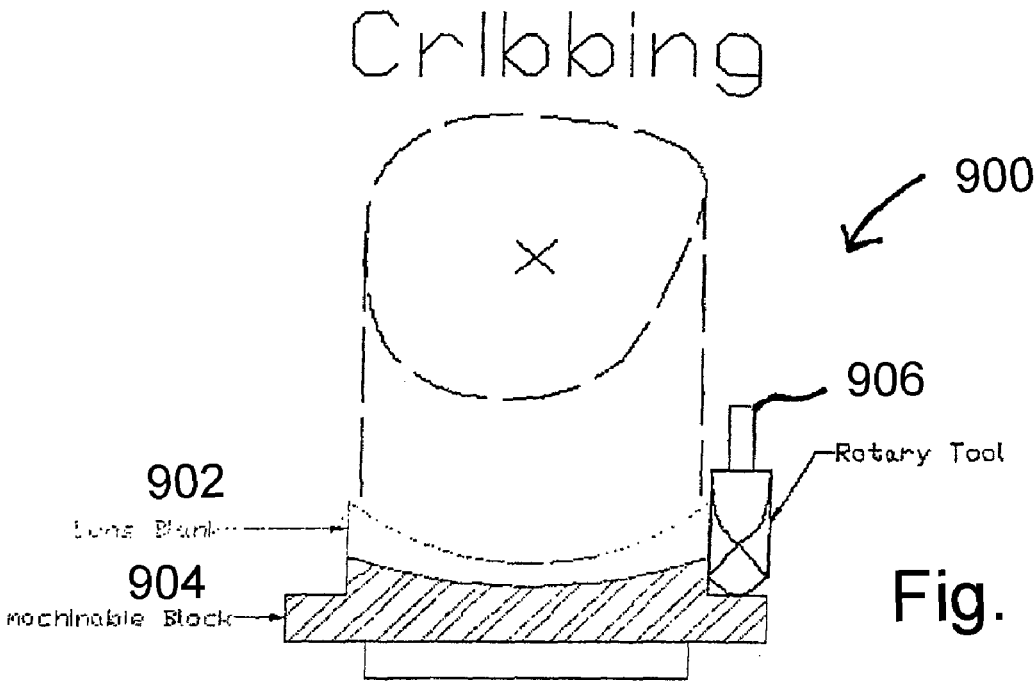
FIG. 3 shows an schematic view of a machining platform in the process of cribbing a lens blank using a rotary cutting tool.
Figure 4:
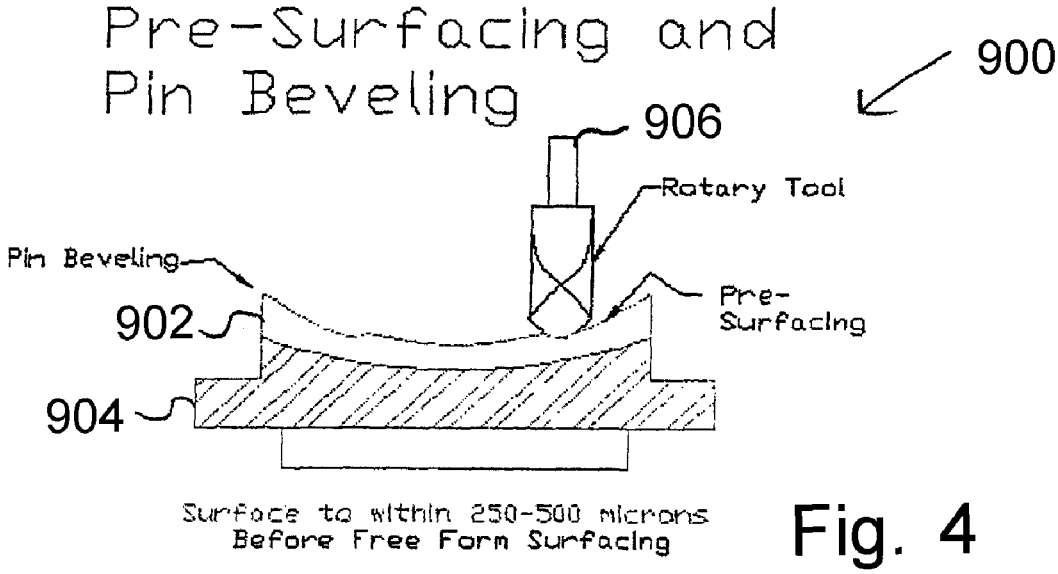
FIG. 4 shows a schematic view of the machining platform in the process of rough surfacing and pin beveling the lens blank using the same rotary cutting tool.

FIG. 3 shows a schematic view of a machining platform 900 in the process of cribbing the lens blank 902 using a rotary cutting tool 906. Here the block 904 is comprised of a machinable material which does not impede the positioning of the rotary cutting tool. FIG. 4 shows the machining platform 900 in the process of rough surfacing and pin beveling the lens blank 902 using the same rotary tool 906.

Referring back to FIG. 2, with the lens still mounted on the machining platform the described method may include a machining step 804 involving lathing with a diamond tool. Here the lathing stage machining step 804 may include fine finishing the back surface by lathing to generate a surface that is of sufficiently close approximation to the final lens surface and having a surface roughness fine enough for conformable lap tool polishing. The lathing stage machining step 804 may also include pin beveling using the diamond tool. As described previously, a rough pin beveling may be executed during the rotary stage machining step 802 and then a fine pin bevel, for extra smoothness, may be generating by the lathing stage machining step 804.

Figure 5:
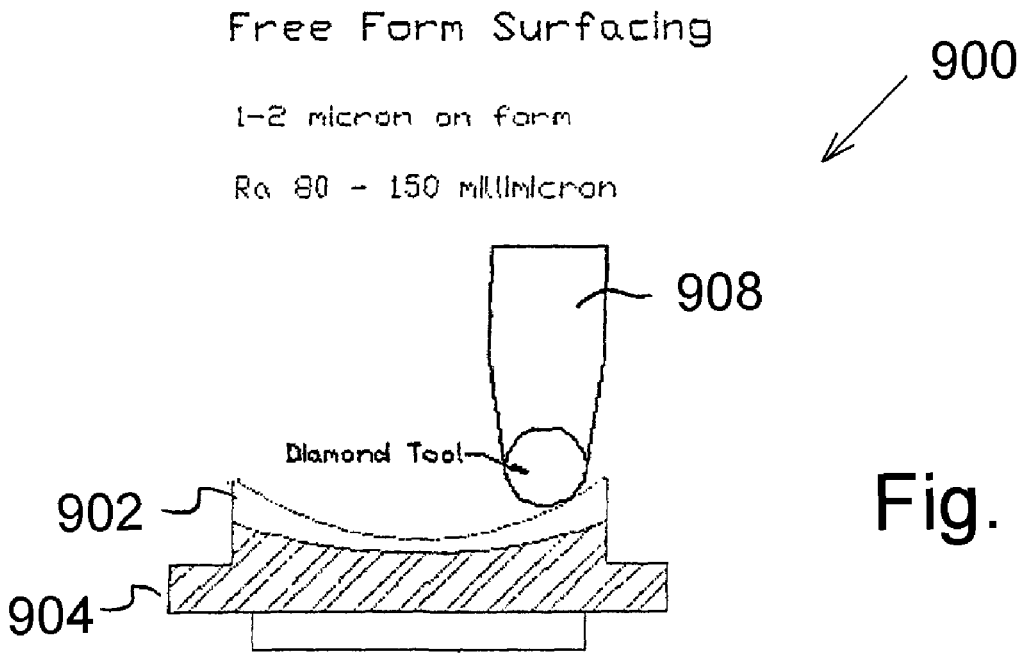
FIG. 5 shows a schematic view of the machining platform during a lathing stage in which a diamond tool performs fine finishing free form surfacing of the lens blank.

FIG. 5 shows the machining platform 900 during the lathing stage in which a diamond tool 908 performs fine finishing free form surfacing of the lens blank 902. In the exemplary embodiment the diamond tool may have a spherical tip with a radius of about 6 mm. However, it is to be understood that in alternative exemplary embodiments the diamond tool may have other dimensions and configurations for the tip.

When the back surface of the lens blank is titled as a result of geometric center blocking of the lens blank, the tool paths for lathing a fine surface onto a lens when that surface is not normal to the center of rotation requires several special considerations. Using a typical tool path for lathing these "tilted" surfaces is not sufficient. A typical tool path for example may include spiraling in from the outside edge of a work piece to the center of the work piece. With such motions, the linear velocity of the lateral movement of the tool is generally constant. Constant linear motion of the tool would produce a finer finish near the center of the lens than near the periphery. That is because the production of a surface with uniform roughness over the entire surface requires even spacing of the "passes" of the spiral when looked at from the center of curvature of the surface. This requires "passes" that are spaced at equal angles from the center of the surface.

Figure 9:
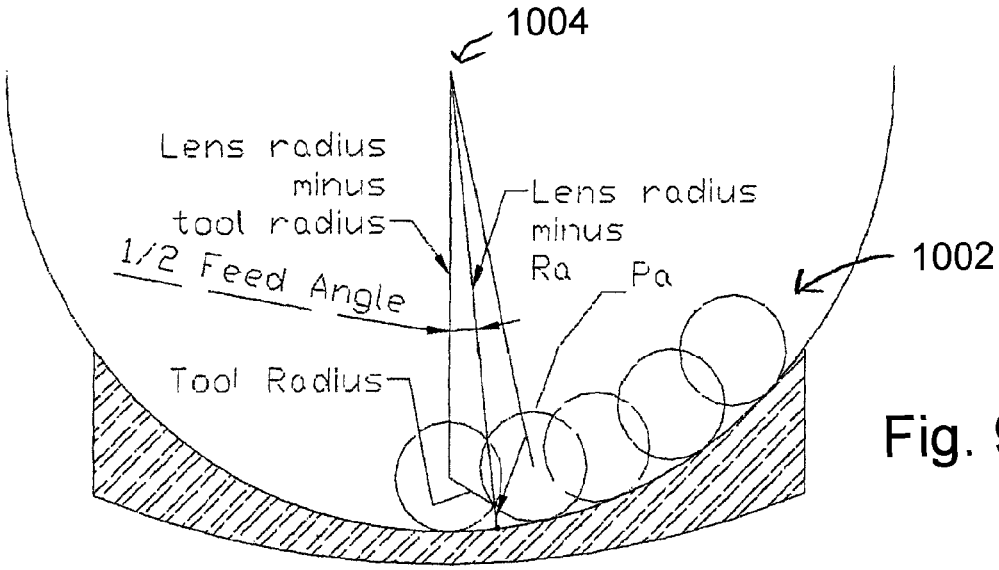
FIGS. 9-11 show schematic views of a tool lathing the back surface of a lens blank.

FIG. 9 shows several passes 1002 of a tool that are positioned to occur at equal angles from the center of curvature 1004. Observe that the linear distance (along the path that the diamond tool would traverse) between two successive passes at the edge need to be closer together than the linear distance between two successive passes near the center. In the case of polishing the lens surface, non-uniformity of surface roughness across the surface creates problems because "ridges" (resulting from using a radiused tool) polish faster than a flat surface. Therefore, unevenness in surface roughness will result in the alteration of the surface when polishing because the amount (thickness) of material removed during the polishing step will not be uniform. In the case of applying coatings to the lens surface, any unevenness in surface roughness across the surface may result in uneven surface tension effects which would create a variation in the thickness of the coating across the surface.

For more rigorous treatment of the "shape" and pitch of the spiral, the tool paths for lathing in the exemplary embodiment may be calculated to take into account the position of the center of curvature of the surface being lathed to achieve spiral passes that are spaced at equal angles from the center of the surface. In one exemplary embodiment the feed angle for the tool paths may be calculated using the formula shown in equation $$1.\ \text{Feed Angle}=2*\text{ArcCos}(c^2+a^2-b^2)/2ac \quad (1)$$

Here the "a" value corresponds to the lens radius minus the tool radius. For a toric lens the shortest radius may be used for the lens radius.

The "b" value in the equation corresponds to the tool radius.

The "c" value in the equation corresponds to the lens radius—Ra.

Figure 10:
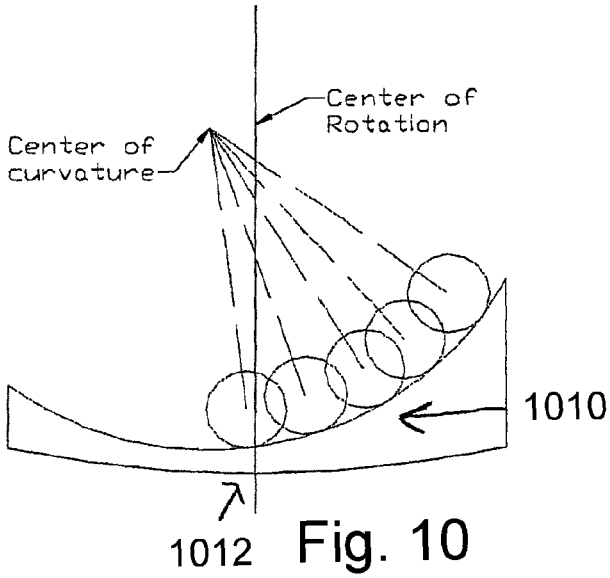

Another special consideration is depicted FIG. 10. When lathing a "tilted" surface 1010, the center of the tip of the tool may not contact the center of the lens when the tool dwells over the center of rotation 1012 of the lens by the machining platform. As a result, not all of the surface will be completed if the typical lathing tool paths are employed and a small elliptical region of the surface will be left unsatisfactorily surfaced.

Figure 11:
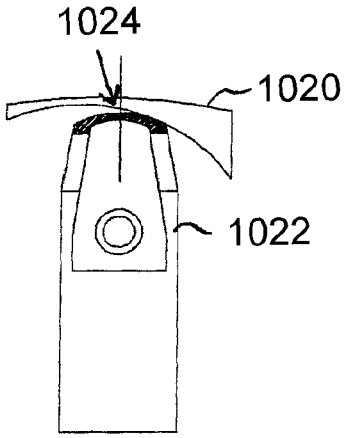

FIG. 11 illustrates this effect. For emphasis, the lens has been reduced in size relative the size of the diamond tool 1022. Here, the diamond tool 1022 is shown dwelling on the midline while in contact with the lens surface. However, in this position, the diamond tool does not contact the lens at the center of rotation 1024 of the lens work piece.

In the exemplary embodiment to prevent such a small elliptical region from being left un-surfaced, tool paths may be calculated which cause the tool tip to pass the center line by a very precise amount, at which point the tool tip is lifted from the surface at precisely the right position and orientation in order to avoid placing undesirable machining artifacts onto the lens surface. In the exemplary embodiment, the amount of traverse over the centerline prior to lifting the tool, may be calculated as a function of the tilt of the lens and the radius of the tool tip.

In addition, in order to achieve the accuracy required to lath the lens surface in the manner described, the tool tip should possess certain attributes. For example in exemplary embodiments, the circularity of the diamond tool must either be precise enough to produce the desired precision of surface or the tool must be mapped for any deviations from true circularity and then compensations must be made to the tool paths to compensate for these irregularities.

Referring back to FIG. 2, once the back surface has been fined to within a distance of about 1 to 2 microns for example of the final lens surface, the method may comprise a step 806 of polishing the back surface of the lens. In one exemplary embodiment the back surface may be polished using a moistened polish impregnated conformable lap or soft-lap polishing tool. The soft-lap polishing tool may be pressed against the lens back surfaces and may be made to oscillate against the lens surfaces while the lens is rotated and dithered relative to the oscillating lapping surfaces. In an alternative exemplary embodiment the polishing step 806 may include bathing the lap-lens interface in recirculating polishing slurry. Such a slurry may be chilled using heat removal device. Such a heat removal device may be incorporated into the machining platform. In further alternative exemplary embodiments the polishing step may include polishing gels or pastes which are introduced into the lens-lap interface.

Figure 6:
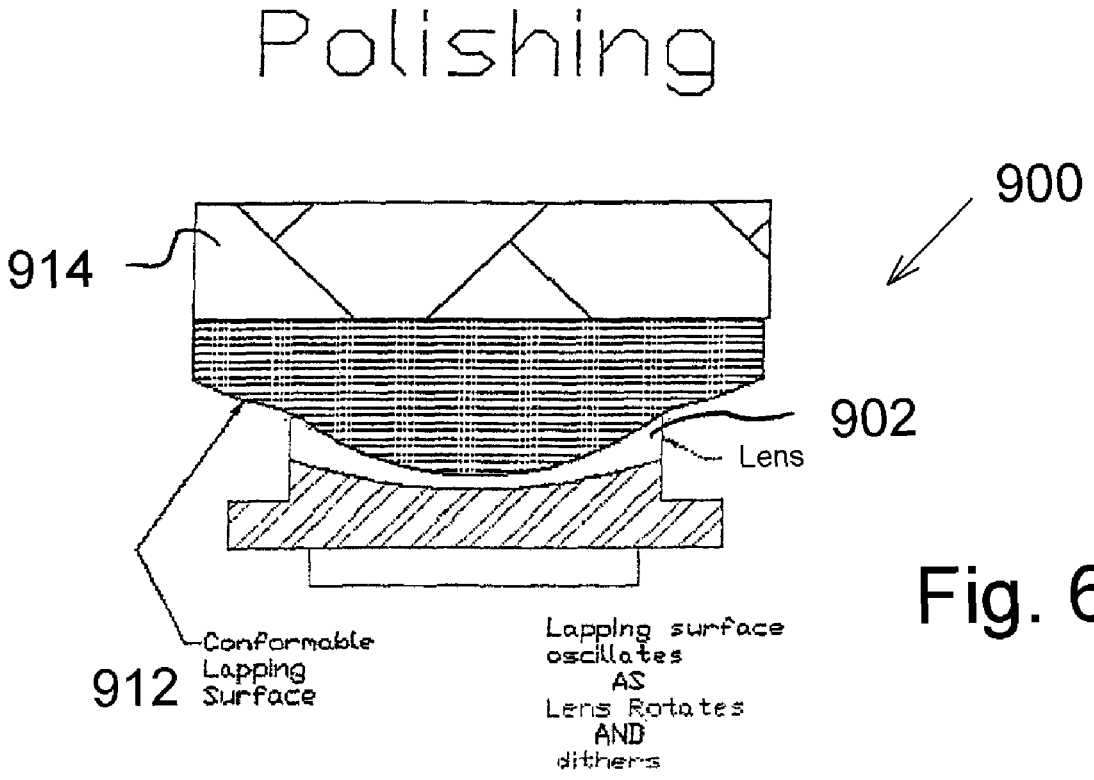
FIG. 6 shows a schematic view of the machining platform which is in the process of polishing the lens blank.
Figure 7:
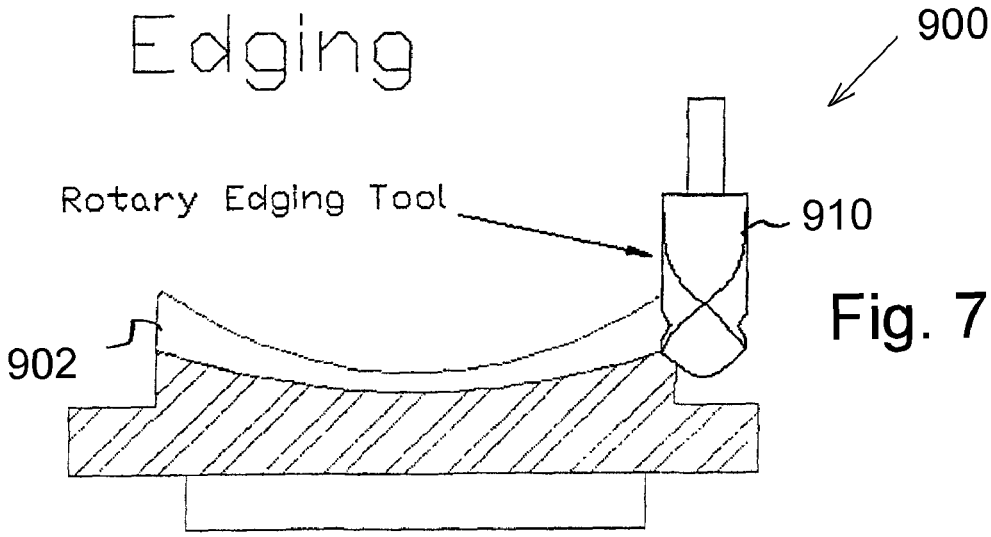
FIG. 7 shows a schematic view of the machining platform in the process of edging the lens blank using a rotary cutting tool.
Figure 8:
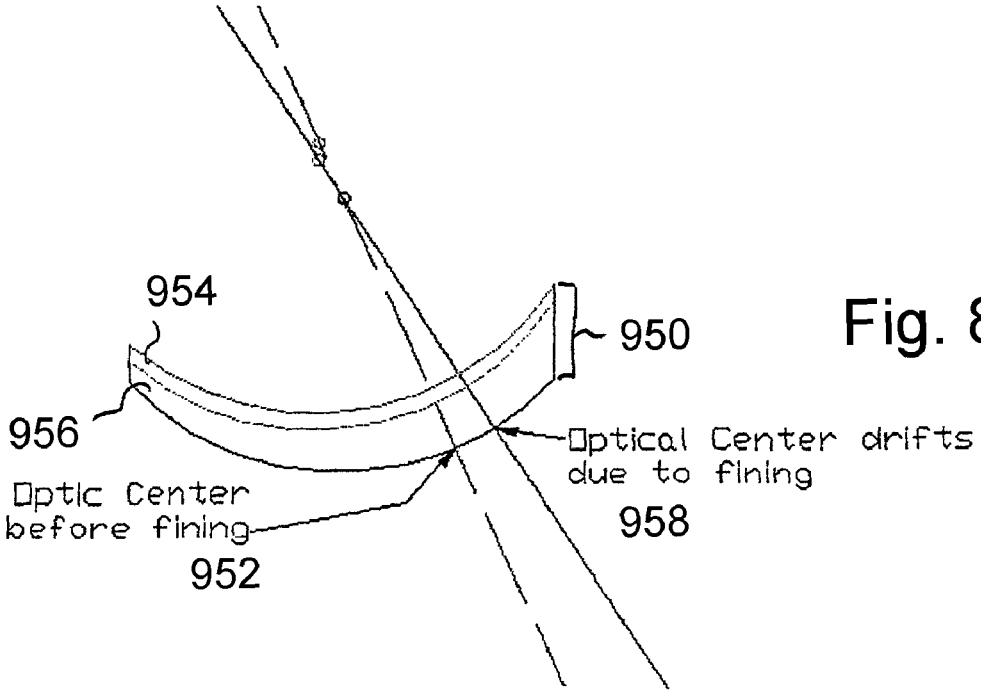
FIG. 8 shows a schematic view of optical creep which may occur as a result of fining a lens with a lap tool.

FIG. 6 shows a schematic view of the machining platform 900 which is in the process of polishing the lens blank 902. Here the polishing is performed using a conformable lapping surface 912 of a soft lap tool 914. In this described exemplary embodiment the machining platform is operative to simultaneously oscillate the lapping surface 912 and rotate and dither the lens blank 902. In alternative exemplary embodiments, the machining platform may have the lapping surface and back surface of the lens blank move with respect to each other in other motions that are operative to polish the lens blank.

Referring back to FIG. 2, the described method may further include a step 808 of edging the lens using the rotary cutting tool. In an exemplary embodiment the edging step 808 may be performed after the polishing step 806. In an alternate exemplary embodiment, the edging step 808 may be performed before, during or after the lathing stage machining step 804. If the lens requires safety beveling, the described method may further include the step 810 of safety beveling the lens. Safety beveling may be performed during either the rotary stage machining step 802 or the lathing stage machining step 804 or both. FIG. 33 shows a schematic view of the machining platform 900 in the process of edging the lens blank 902 using a rotary cutting tool 910.

The described method 800 may further include a step 812 of deblocking the lens from the block. In exemplary embodiments, deblocking of the machined lens from the block may be accomplished by a destructive process in which the machinable block may be split into at least 2 sections using a wedge applied to the back of the block. The splitting of the block may release most of the adhesion at the lens-block interface thereby facilitating deblocking. The described method may include a block constructed so as to facilitate the destructive parting.

In addition to the previously described method steps of generating a custom block for each lens blank responsive to frame and prescription data for the finished lens, exemplary embodiments may further include a process of pre-blocking lens blanks with spherical front surfaces without being responsive to frame and prescription data for the finished lens. For example, this alternative exemplary embodiment may include mounting lens blanks to blocks before the prescription variables, frame dimensions, or frame shapes are known for producing finished and edged ophthalmic lenses from these pre-blocked lens blanks.

In this described exemplary embodiment, blocks adapted for use with pre-blocked lens blanks, may be standardized for use with the machining platform such that either the direction or location of the axis of rotation of each pre-blocked lens blank when mounted to a machining platform may be known for each pre-blocked lens blank and/or the angle of a relative feed axis of a cutting tool of the machining platform may be know relative each pre-blocked lens blank when mounted to the machining platform.

These blocks used for pre-blocking lens blanks may be manufactured through a molding, machining, or any other fabricating process. To optimize the blocking of the lens for edging by the machining platform, the spherical front surface lens blank may be mounted to the block in an orientation in which a direction normal to the front surface of the lens blank at any radius of the spherical front surface of the lens blank that intersects the front surface of the blank at a position that will allow for the lens to "cut out" during edging is parallel to either the axis of rotation of the block or the relative feed axis of a cutting tool when the block is mounted to the machining platform. When spherical front surface lens blanks are pre-mounted in this manner to such standardized blocks, all of the spatial coordinate points (x, y, z) on the front surface of the lens blank may be determined with adequate certainty relative to the coordinate system of the machining platform when the blocked lens is mounted on the machining platform.

As discussed previously, in this described exemplary embodiment of pre-blocked spherical front surface lenses, the lens may be blocked without being responsive to data corresponding to the prescription of the lens and the configuration of the lens receiving portion of the spectacle frame. As a result, an exemplary embodiment may include a method of pre-blocking spherical front surface lenses during or after the manufacture of the lens blanks. The manufactured pre-blocked lens blanks may then be packaged and distributed to labs which include a machining platform specifically adapted to receive and processes the pre-blocked lens blanks.

In addition, generation of pre-blocked spherical front surface lenses may further include using an adhesive which is operative to perform a relatively stronger bond between the lens and block than may be achieved using waxes and alloys. An example of such an adhesive may include epoxy-resin combinations, cyanoacrylates, thermoplastic compounds, thermosetting compounds, light activated adhesives, polymerizing compounds, auto-polymerizing compounds, or suitable metallic alloys. Pre-blocked lenses using such adhesives may enable the machining platform to more rigidly hold the lens blank in place while machining operations are performed on the lens. As a result the machining platform may be operative to perform more aggressively, higher force, and faster machining than may be performed with lenses blocked using waxes and alloys. In addition, a mold release agent or a protective tape may be positioned between the lens blank and the adhesive on the block. The release agent or the protective tape may provide for de-blocking cleanly without adhesive residue remaining on the lens.

Figure 26:
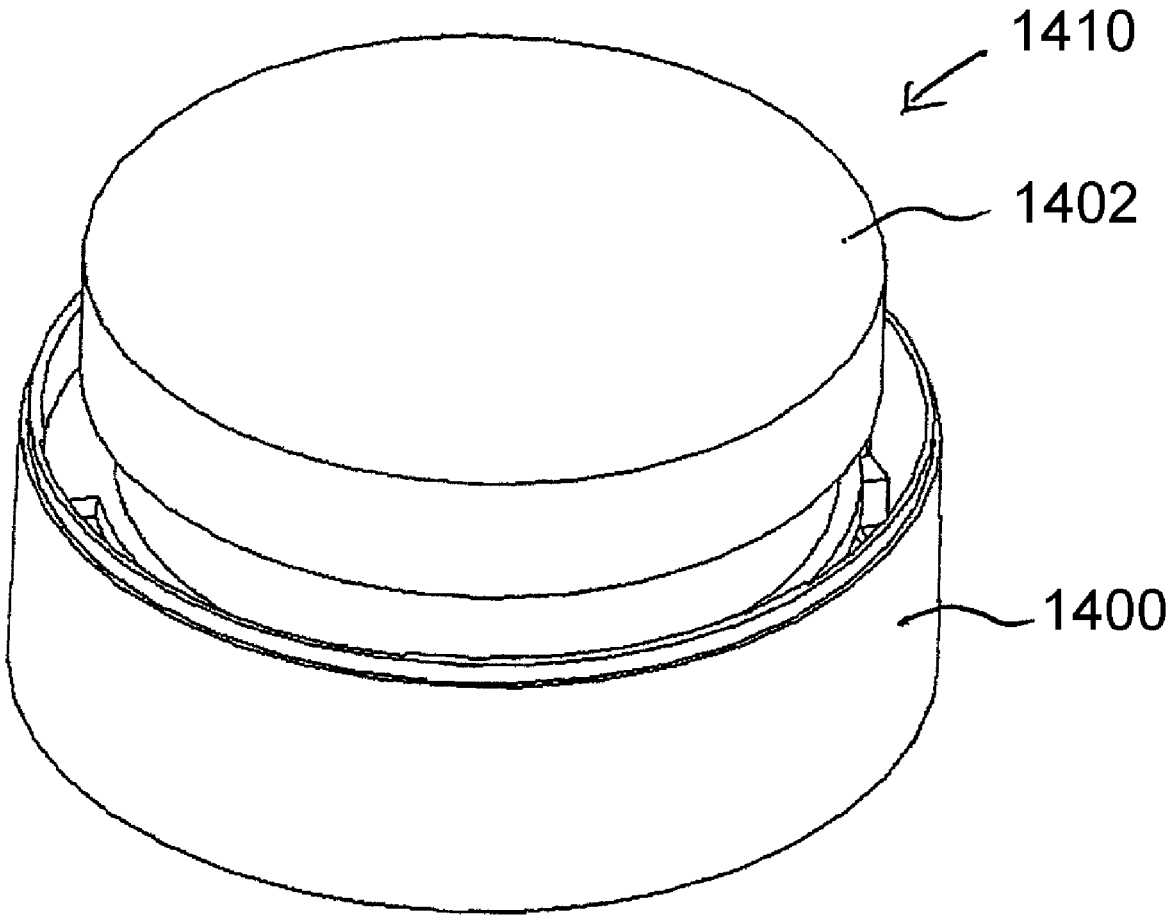
FIGS. 26-30 show examples of blocks for use with pre-blocked lens blank assemblies and pre-blocked finished uncut lens assemblies.
Figure 27:
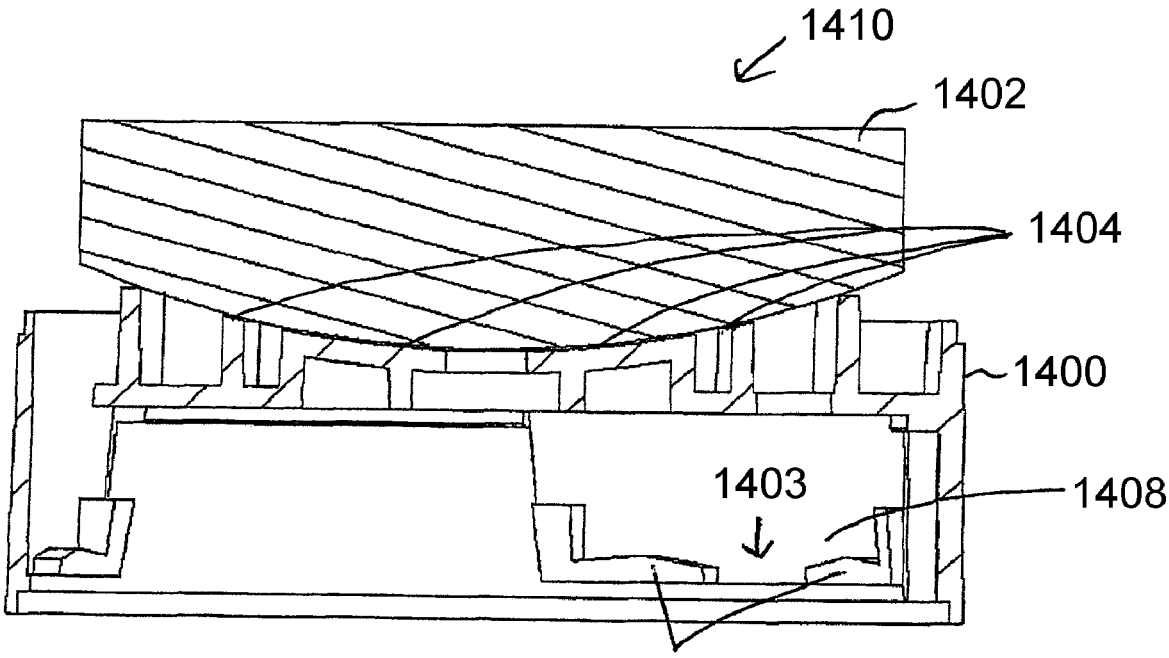
Figure 28:
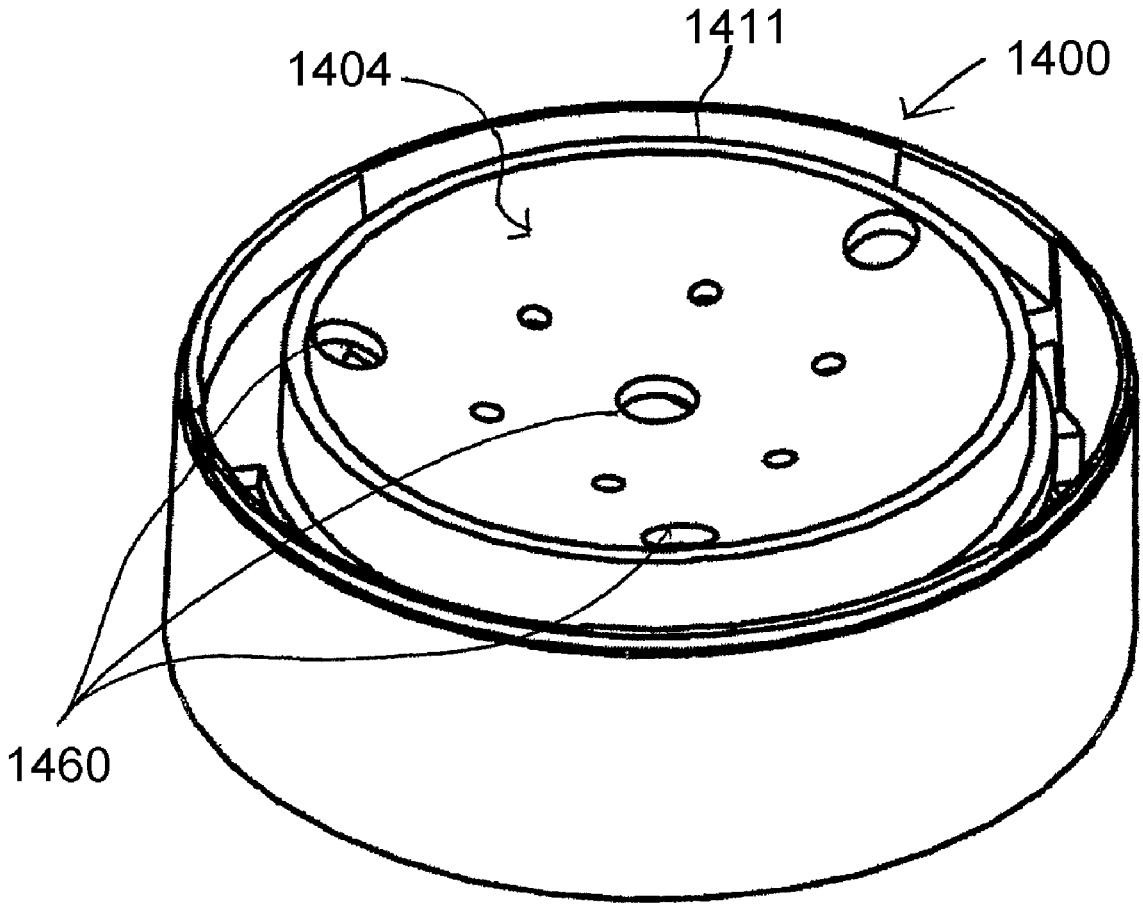

FIG. 26 shows an example of a block 1400 adapted to receive a lens blank 1402 to form a pre-blocked lens blank assembly 1410. FIG. 27 shows a cross-section view of the pre-blocked lens blank assembly 1410. FIG. 28 shows a perspective view of the block 1400 without the lens blank 1402 mounted thereon. As shown in FIGS. 27 and 28, the block includes a lens blank receiving surface 1404 that is formed with a surface contour that corresponds to the front surface topography of the lens blank 1402. The diameter of the surface area of the lens blank receiving surface 1404 may be sufficiently large to support substantially all of the front surface of the lens blank (in adhesive connection therewith) for surfacing, edging and coating, while the block is continually engaged to a chuck or other block engaging portion of a machining platform.

Supporting substantially all of the front surface of the lens blank with the lens blank receiving surface portion 1404 of the block is operative to resist machining forces which could cause lens warpage and/or de-blocking of the lens blank.

Figure 29:
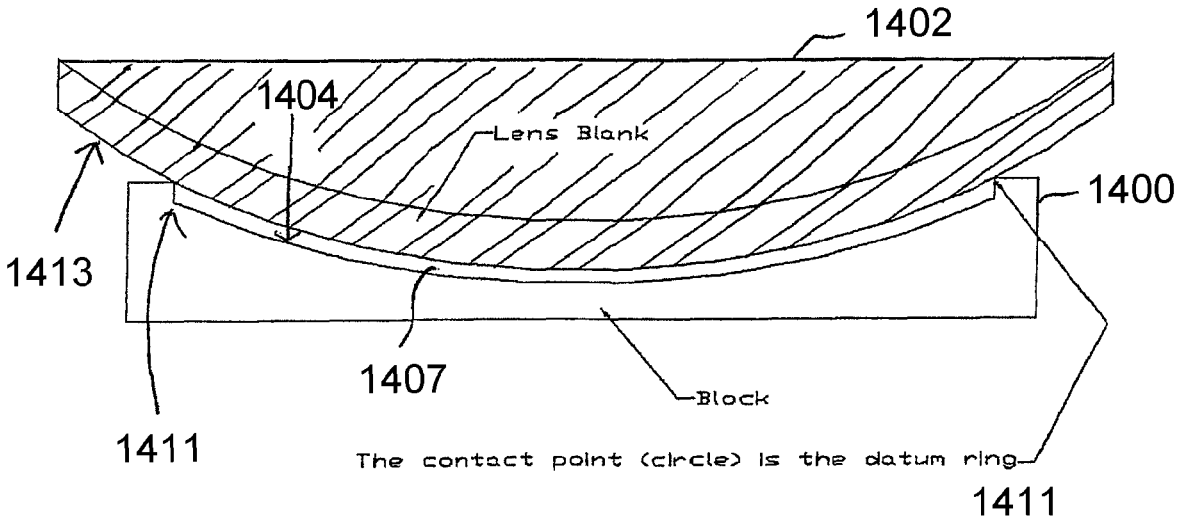

FIG. 29 shows a zoomed in view (not to scale) of the interface between the lens blank 1402 and the block 1400. In an exemplary embodiment, the block 1400 may include one or more raised portions 1411 which extend from the lens blank receiving surface 1404 and directly contact the front surface 1413 of the lens blank 1402. As discussed previously the lens receiving surface 1404 is produced with a contour which corresponds to the front surface topography of the lens blank. Thus, when the lens blank is mounted to the block, the raised portions provide a uniform gap 1407 for placing an adhesive of substantially uniform thickness between the front surface 1413 of the lens blank 1402 and the lens blank receiving surface 1404 of the block.

As shown in FIG. 28, the raised portion or portions 1411 may correspond to a raised datum ring which extends around the lens blank receiving surface 1404. However, it is to be understood that in alternative exemplary embodiments, the raised portion or portions 1411 may correspond to separate spaced apart projections extending from the block.

Figure 30:
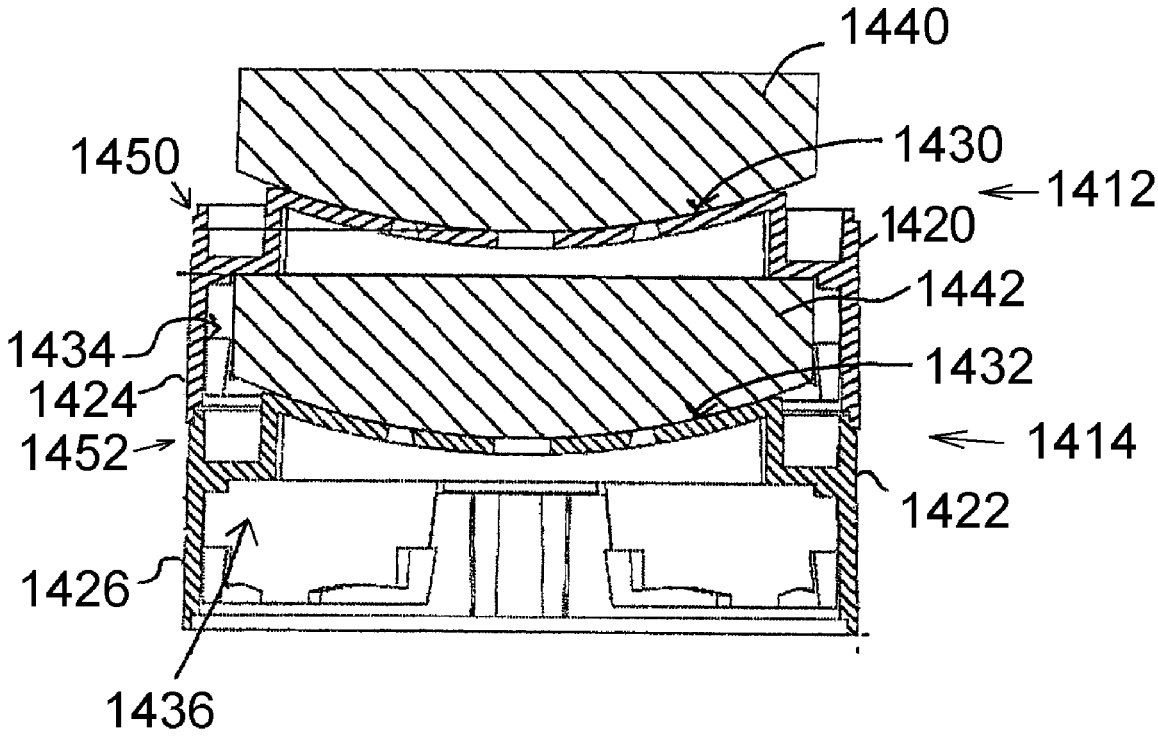

In exemplary embodiments of the pre-blocked lens blank assemblies, the blocks may be adapted to be stackable. FIG. 30 shows a cross-sectional view of one pre-blocked lens blank assembly 1412 stacked on top of another pre-blocked lens blank assembly 1414. As shown in FIG. 30, each pre-blocked lens blank assembly 1412, 1414 includes a respective lens blank 1440, 1442 adhesively mounted to a respective lens blank receiving surface 1430, 1432 of each respective block 1420, 1422.

In this described exemplary embodiment, each block may include a respective annular wall (referred to herein as a skirt) 1424, 1426 which are adapted to engage with each other when axially aligned. Each skirt surrounds in supporting connection therewith the respective lens blank receiving surface 1430, 1432 of the respective block 1420, 1422. In addition each skirt may have a sufficient longitudinal length to form an interior cavity 1434, 1436 underneath the respective lens blank receiving surface 1430, 1432. When stacked, the lens blank 1442 mounted to the lower block 1422 may extend into the interior cavity 1434 of the upper block 1420.

In an exemplary embodiment of these described blocks, the upper and lower edges 1450, 1452 of the skirts of each block may be beveled to cooperatively engage with other blocks stacked thereon and there under. Although in this described exemplary embodiment, the blocks include annular walls or skirts which facilitate stacking of pre-blocked lens blanks assemblies, it is to be understood that alternative exemplary embodiments may include other structures for facilitating stacking of pre-blocked lens blanks assemblies. For example in alternative exemplary embodiments, blocks may include legs, projections or other structures which are adapted to engage with portions of other blocks to facilitate the formation of stable stacks of pre=blocked lens blank assemblies.

In an exemplary embodiment, the described skirts of the blocks may be operative to shield the chuck of the machining platform from debris produced by the machining of the lens blank. In addition when a first block is stacked on a second block, the skirt of the upper first block may have a sufficient height to prevent portions of the upper first block from contacting portions of the lens blank mounted on the lower second block. Thus, during shipping or storage, the skirts of a stack of blocks provide additional protection to the lens blanks which minimizes the opportunity from de-blocking forces from dislodging a lens blank from its respective block.

Exemplary embodiments of the described block may further include one or more channels between the lens and the block which are capable of accepting a de-blocking device such as a wedge. The wedge may be inserted into the channel to facilitate de-blocking at the end of the manufacturing process.

Exemplary embodiments of the described blocks may include engagement features which facilitate quick engagement or chucking of a block to the chuck or block receiving portion of a machining platform. As shown in FIG. 27, such engagement features may include a plurality of ramps and/or detents 1406 formed adjacent the lower edge of the skirt 1408, which engage with correspondingly sized and positioned projections of a chuck of the machining platform.

Figure 31:
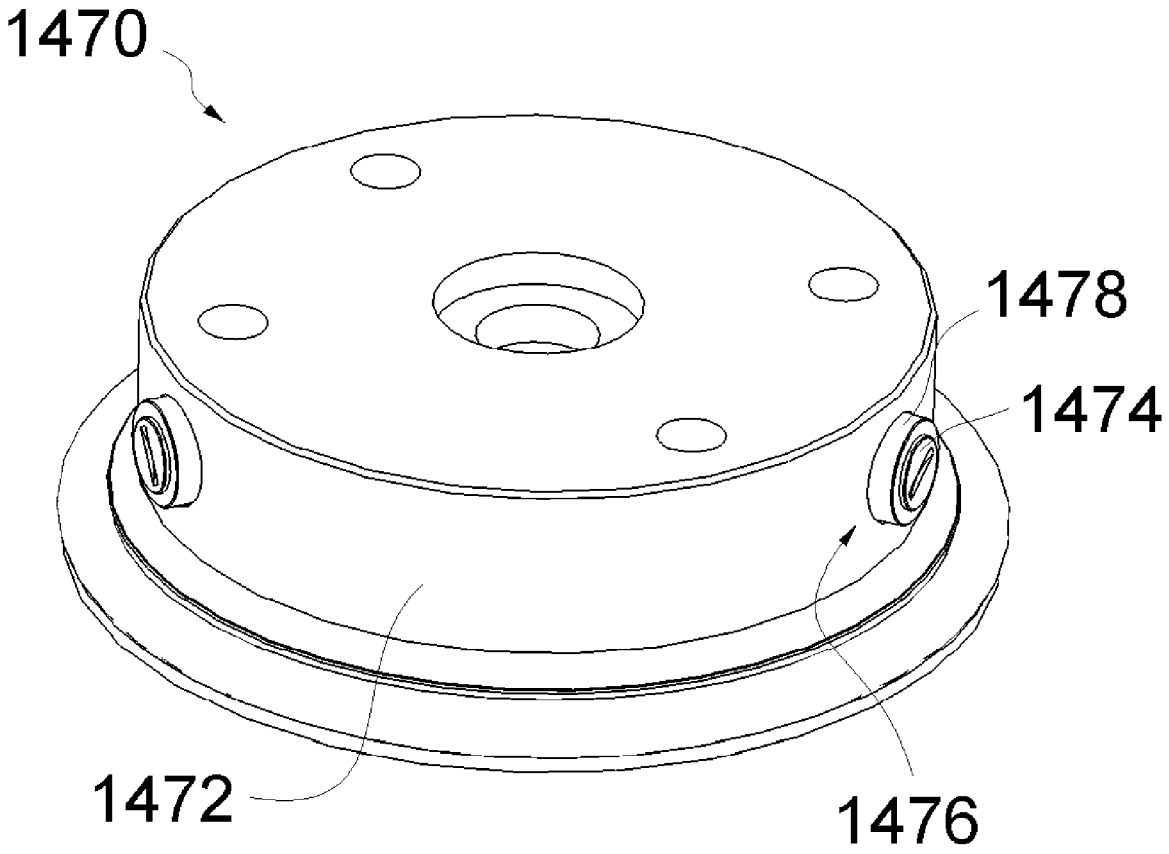
FIG. 31 shows an example of a chuck of a machining platform which receives pre-blocked lens blank assemblies and pre-blocked finished uncut lens assemblies.

FIG. 31 shows an example of a chuck 1470 of a machining platform. In this described exemplary embodiment, the chuck may include a generally cylindrical portion 1472 which slides within the interior cavity of the block. The cylindrical portion 1472 may include a plurality of radially extending projections 1476 which engage with the previously discussed ramps and/or detents 1406 of the described block 1406. For example, in an exemplary embodiment, the described block 1400 shown in FIG. 27 may be mounted on the described chuck 1470 shown in FIG. 31 by aligning the radial projections 1472 of the chuck with slots 1403 formed in the inner surface of the skirt 1408 of the block. The block may then slide over the cylindrical portion 1472 of the chuck so that the projections 1476 slide through the slots 1403. The block may then be rotated or twisted so that the radial projections slide over the ramps and/or detents 1406.

In an exemplary embodiment of the chuck, the radial projections 1476 may correspond to cam followers, while the ramp and/or detents correspond to a cam surface. When a block is twisted on the chuck, the ramps and/or detents 1406 slide over the cam followers to produce clamping forces which lock the block to the chuck. In an exemplary embodiment of the described chuck, friction forces between the radial projections 1476 and the ramps and/or detents 406 may be reduced by having the radial projections include rings or wheels 1478 which rotate with respect to axles 1474 extending from the cylindrical portion of the chuck. In exemplary embodiments of the described block and chuck, the angular positions of the locations of the described slots may be asymmetrically positioned relative to each other around the skirt. Likewise in a corresponding manner, the radial projections of the chuck may be asymmetrically positioned relative to each other around the cylindrical portion. By asymmetrically positioning the relative locations of the slots and radial projections, blocks must be mounted to the chuck in the same predetermined angular position relative the angular position of the chuck. This enables the rotational position of the front surface of the lens blank to be readily determinable relative the coordinate system of the machining platform, and prevents blocks from being mounted in random angular orientations relative to the chuck.

For example, exemplary embodiments of the block and corresponding chuck may include three respective slots and radial projections. Such slots may be spaced apart around the skirt with different (e.g. non-uniform or asymmetric) angular distances there between. Likewise the radial projections of the chuck may be spaced apart in a corresponding manner with different angular distances there between.

As shown in FIG. 28, the lens blank receiving surface 1404 may include holes 1460 there through which permit measuring sensors to extend there through and contact the front surface of the lens blank. In an exemplary embodiment, the lens blank receiving surface portion 1404 includes at least three holes there through. Individual measuring sensors may extend through the holes and provide measurements usable by a processor in the machining platform to determine and/or verify the orientation of the front surface of the lens blank relative to the block, chuck, and/or the machining platform. Although the process of pre-blocking the same type of lens blank in the exemplary embodiment is carried out in a manner which attempts to uniformly orientate the front surfaces of the lens blanks relative their respective blocks, the measuring holes in the block permit a measuring device to verify and/or calculate the orientation of each lens blank after being mounted to its block.

In an exemplary embodiment, the adhesive may be applied between the lens blank and the block such that the adhesive is absent from the front surface of the lens blank at the locations of the holes 1460. However, in alternative exemplary embodiments, the adhesive may be applied with a uniform thickness adjacent the holes 1460 to permit the measuring device to compensate for the thickness of the adhesive when carrying out a measurement of the location of the lens blank relative the block.

In an exemplary embodiment, the measuring device may be used to measure each pre-blocked lens blank assembly during the manufacturing process of the assemblies. Data representative of the orientation of the front surface of the lens blank relative the block may then be stored on the block in a machine readable format (e.g. barcode, RF-1D tag, magnetic stripe) and/or a human readable format (e.g. printed numbers). In an exemplary embodiment, the machining platform may include a reading device capable of reading the front surface orientation data stored on each block. The processor of the machining platform may then be responsive to the orientation data read from the block to determine the tools paths used to machine the lens blank. Alternatively, the machining platform may include an input device such as a keypad, through which an operator may manually type in the orientation data manually read from the block.

In a further exemplary embodiment, the machining platform may be in operative connection with the measuring device. An operator of the machining platform may use the measuring device to measure the orientation of the lens blank relative the block prior to mounting the block to the chuck. The measuring device may be operative to directly communicate to a processor in the machining platform, measured data representative of the ordination of the lens blank relative to the block and/or the machining platform. Alternately, each chuck of the machining platform may include measuring sensors thereon, which are operative to measure the orientation of the front surface of the lens blank through the holes in the block after the block is mounted to the chuck.

Exemplary embodiments of the blocks may include additional features which enhance the productivity of the machining platform and reduce errors. For example, each block may include identifying data stored thereon in a machine readable format (e.g. barcode, RF-ID tag, magnetic stripe) which specifies one of a plurality of predefined types of the lens blank, optical properties of the lens blank, and other features useful for identifying the lens blank. The identifying data may be used to assist in tracking and quantifying an inventory of pre-blocked lens blank assemblies. In addition, the machining platform may include a reading device capable of reading the identifying data from each assembly so as to verify that the correct pre-blocked lens blank assembly for a specified operation has been mounted. For example, an operator using the machining platform may provide data to a processor of the platform representative of a lens prescription which requires a specific type of lens blank to be machined by the machining platform. Prior to commencing the machining of the lens blank, the processor of the machining platform may be operative to verify that the expected pre-blocked lens blank assembly corresponds to the actual pre-blocked lens assembly mounted to the machining platform by comparing the identifying data read from the assembly to data representative of the required type of lens blank for the intended lens prescription.

In addition, the location of the identifying data on the block may be measured by the machining platform and used to verify that the block has been fully and securely chucked on the machining platform. Also, for machining platforms that include the capability to machine both the left and right lens for a pair of eyeglasses, the machining platform may be adapted to allow the operator to place the required pre-blocked lens blank assemblies for the two lenses on either chuck of the machining platform. The processor of the machining platform may then be responsive to the identifying data read from each of the two pre-blocked lens blanks to correlate the correct tool paths for machining each of the left and right lenses to the correct corresponding pre-blocked lens blank assembly.

In addition, the processor of the machining platform may be operative responsive to an inputted prescription to output identifying data usable by an operator to select from inventory the correct pre-blocked lens blank assembly. Such identifying data useful to an operator may include a unique human readable number, name symbol or other indicia which is found on the particular type of pre-blocked lens blank assembly that is to be machined by the machining platform. In addition, different types of pre-blocked lens blank assemblies may include other visual characteristics to enable an operator to distinguish one type from another. For example, different types of pre-blocked lens blank assemblies may include blocks with unique colors.

Aspects of the previously described system and method for forming and using pre-blocked lens blank assemblies may also be used to pre-block finished uncut lenses. Such finished uncut lenses correspond to ophthalmic lenses with finished front and back surfaces but with edges that have not yet been machined for a particular eyeglass frame. Such finished uncut lenses may be pre-blocked as described above to form pre-blocked finished uncut lens assemblies. As with the pre-blocked lens blank assemblies, the pre-blocked finished uncut lens assemblies may be manufactured prior to knowing the frame dimensions or frame shape intended for the final lens edged from the pre-blocked finished uncut lens assemblies.

In this described embodiment, the same blocks and machining platform described above for use with pre-blocked lens blank assemblies may be used with pre-blocked finished uncut lens assemblies. However, because the front and back surfaces are already finished, the machining platform may be operated to forgo machining the back surface and instead may proceed to edge the finished uncut lens responsive to data representative of the desired frame shape.

Figure 32:
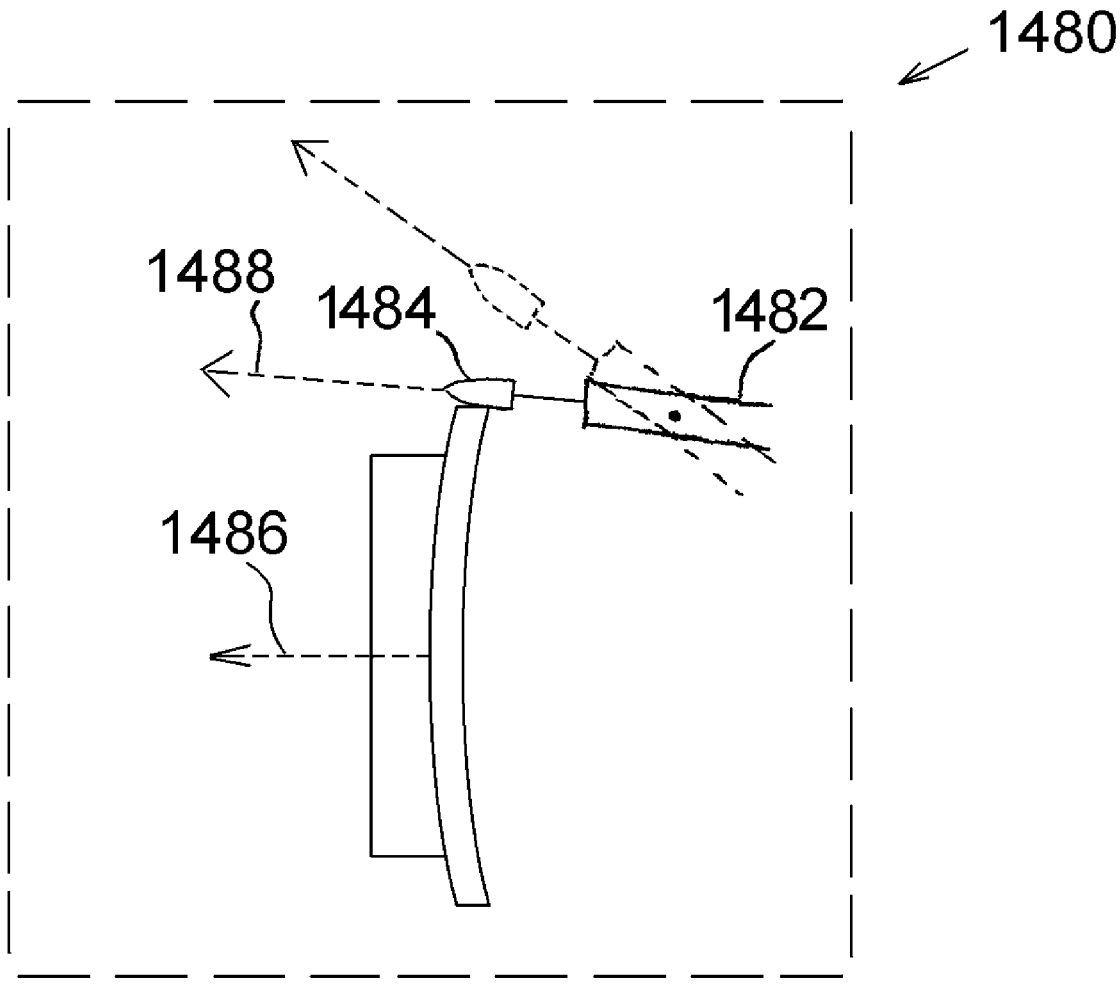
FIG. 32 shows an example of a portion of a machining platform adapted to articulate the axis of rotation of a tool relative a front surface normal of a lens being edged using the tool.

Exemplary embodiments of a machining platform adapted to process pre-blocked lens blank assemblies and/or pre-blocked finished lens assembles (collectively referred to herein as "pre-blocked lens assemblies") may have the ability to mechanically incline/decline (articulate) the angle of the axis of rotation of the edging tool relative to the normal at the geometric center of the finished lens. This may be accomplished by pivoting the axis of rotation of the rotating spindle motor that powers the rotary edging tool. FIG. 32 shows an example, a machining system 1480 capable of articulating the rotating spindle motor 1482 of the edging tool 1484. Articulation of the axis of rotation 1488 of the edging tool, enables the machining platform to produce edges for the lens which are about parallel to a normal 1486 at the final geometric center of the edged lens.

Figure 22:
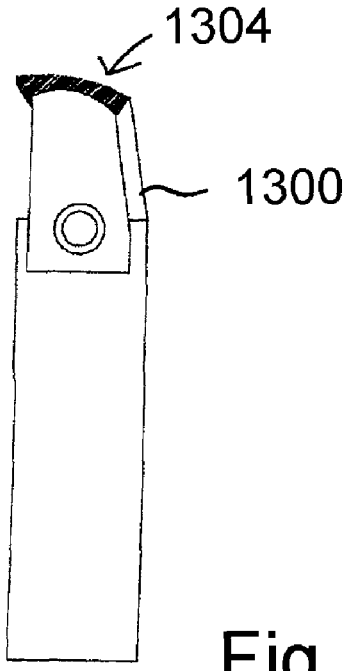
FIGS. 22-25 show schematic views of an exemplary embodiment of a lathing tool which is operative for use with the machining platform to perform both edging and back surface generation of a lens blank.
Figure 23:
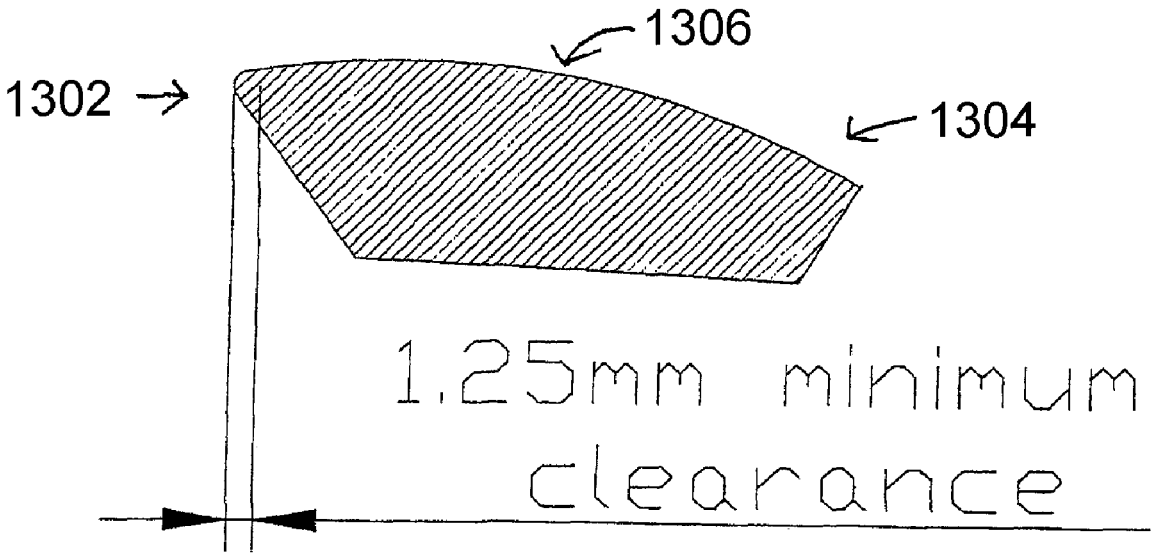
Figure 24:
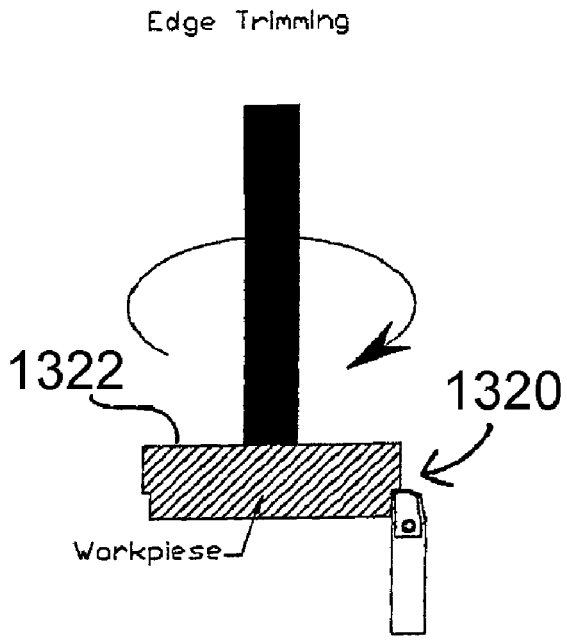
Figure 25:
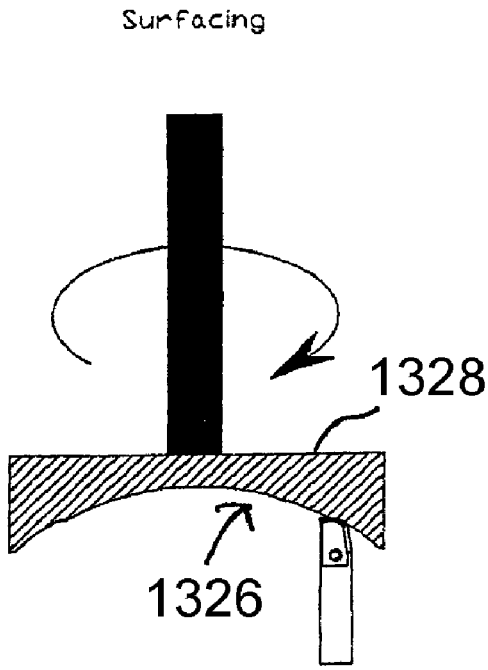

As discussed previously, a rotary tool may be used for both back surface generation and edging of a lens blank. However, in alternative exemplary embodiments, the machining platform may be operative to use a lathing tool to perform both edging and back surface generation. FIG. 22 shows an example of an exemplary embodiment of a lathing tool 1300 which may be used to both edge and surface a lens blank with the machining platform. As shown in FIGS. 23-25, the tip 1304 of the lathing tool may include a side portion 1302 with a contour that is operative for use with lathing an edge 1320 of a lens 1322 (FIG. 24) and an upper portion 1306 with a contour that is operative for use with lathing a back surface 1326 of the lens 1328 (FIG. 25).

In the exemplary embodiment, the lap tool surfaces and the machinable layer of the blocks may bee made from the same low melting point wax that is used to block the lenses. Other low melting point substances could be adapted to serve the same purpose such as a thermoplastic material, a metallic alloy or any other material that may be machined by the machining platform. A substrate of this low melting point wax or other material may be applied fairly thickly to the base of each lap tool and block. Alternately, disposable machinable materials of various compositions could be employed as the lap tool or the mounting block substrate.

As discussed previously, in an exemplary embodiment, the same machining platform which is operative to machine the back surface of the lens blank with a rotary cutting tool and/or lathing tool may also be used to polish the back surface with a confirmable lapping tool. In exemplary embodiments of the machining platform the lens blank may be held in a fashion which constrains motion so that the lens cannot rock and pitch in order to stay in intimate contact with the moving lapping surface. Polishing the back surface of a lens blank with a conformable lapping surface when that lens blank is held in a fashion that constrains motion in this manner can cause rapid re-conformation of the conformable lapping surface. Forces involved in rapid reconformation of the surface shape of a conformable lap tool can introduce unwanted vibrations and uneven surface pressures across the "lens-to-lapping-surface" interface if the degree of re-conformation is excessive. The use of fluid lapping media of various degrees of viscosity may be used to eliminate these problems within this context, but there are problems involved in containment of these fluids and it is often difficult to avoid contamination of these relatively expensive fluids.

In an exemplary embodiment the machining platform may be operative to produce motions of a conformable lapping surface of a lap tool which follow the curvature of the lens in order to minimize the degree of re-conformation required of the conformable lapping surface.

Figure 19:
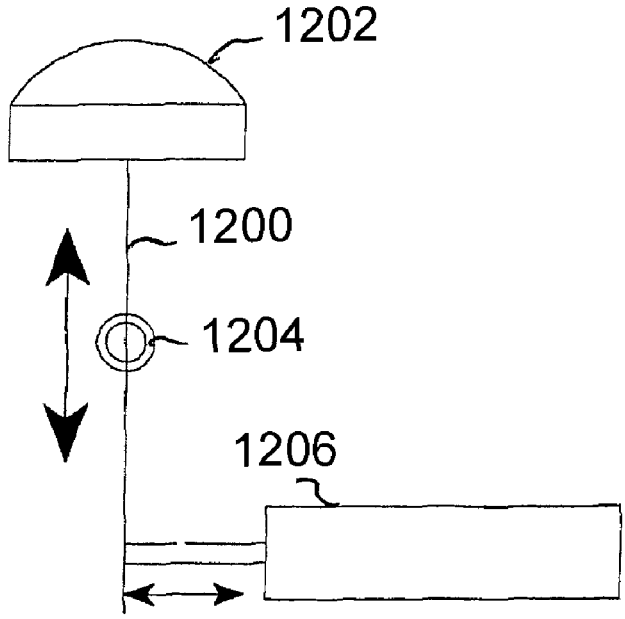
FIGS. 19-21 show schematic views of an exemplary embodiment of conformable lapping surface motions provided during a polishing stage with an exemplary embodiment of the machining platform.
Figure 20:
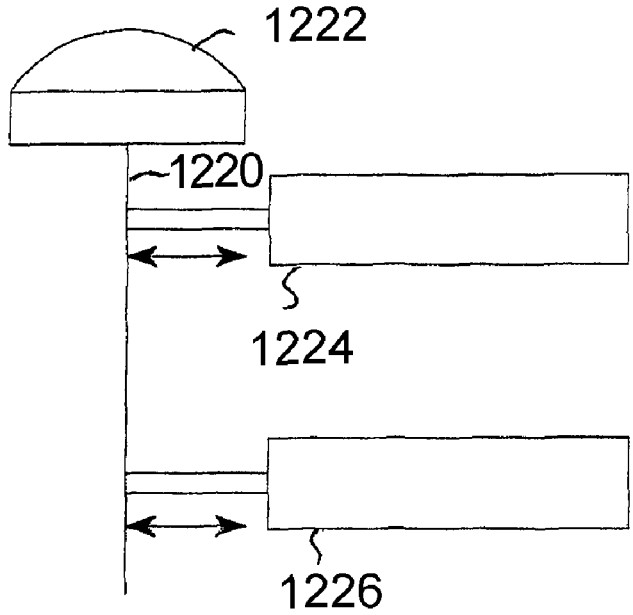
Figure 21:
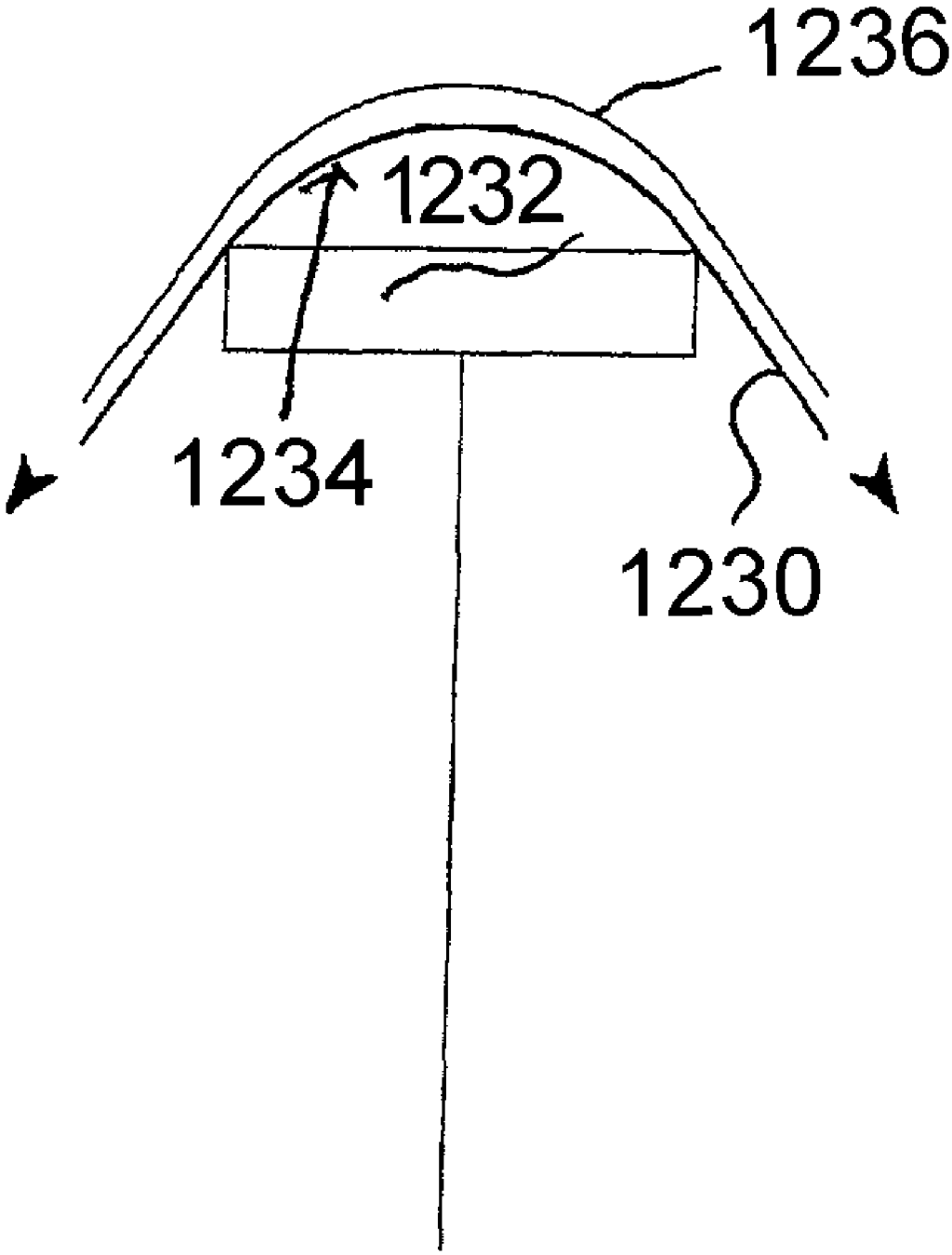

FIGS. 19-21 show various conformable lapping surface motions produces during exemplary embodiments of a polishing stage performed by the machining platform. For example in the described exemplary embodiment of the machining platform, when a lens is held in relative immobility during polishing, the lens may only be able to rotate at one axis (e.g. by rotation of the arbor) and to translate in one dimension perpendicular to that axis (e.g. by rotation of articulation shaft). As a result, this described exemplary embodiment of the machining platform may be configured to make a lapping tool undertake the motions shown in FIGS. 19-21 in order to minimize the amount of re-conformation required of the conformable lapping surface.

FIG. 20 shows an exemplary embodiment of a polishing stage wherein a linkage 1200 to the polishing head 1202 of a lap tool is connected to one actuator 1206 and one pivoting device 1204. The pivoting device 1204 is able to move relative to the point at which the actuator 1206 is connected to the linkage 1200 while remaining connected to the linkage 1204. This arrangement allows for a wide range of variability in the radius of motion of the lap tool lapping surface. Additionally, in the case of a toric lens that would present with varying radii in the plane of oscillation of the lap tool as the lens is made to rotate, the radii of motion of the lap tool lapping surface can be made to change dynamically in response to the changing radius of the lens in the plane of action of the lap tool. The magnitude and frequency of stroke can also be controlled statically or dynamically in such a configuration by varying the magnitude and frequency of the motion of the actuator.

FIG. 20 shows an alternative exemplary embodiment of a polishing stage wherein two points of a linkage 1220 to the polishing head 1220 of a lap tool are attached to actuators 1224, 1226. This configuration also provides for infinite positioning of the center of oscillation and for variation in stroke magnitude and frequency.

FIG. 21 shows an alternative exemplary embodiment of a polishing stage wherein a suitably pliable sheet of conformable polishing substrate 1230 is confined between a conformable surface 1234 of a lapping tool 1232 and the lens 1236. The substrate is pulled across the lens surface in a stropping motion to accomplish the polishing process.

Figure 12:
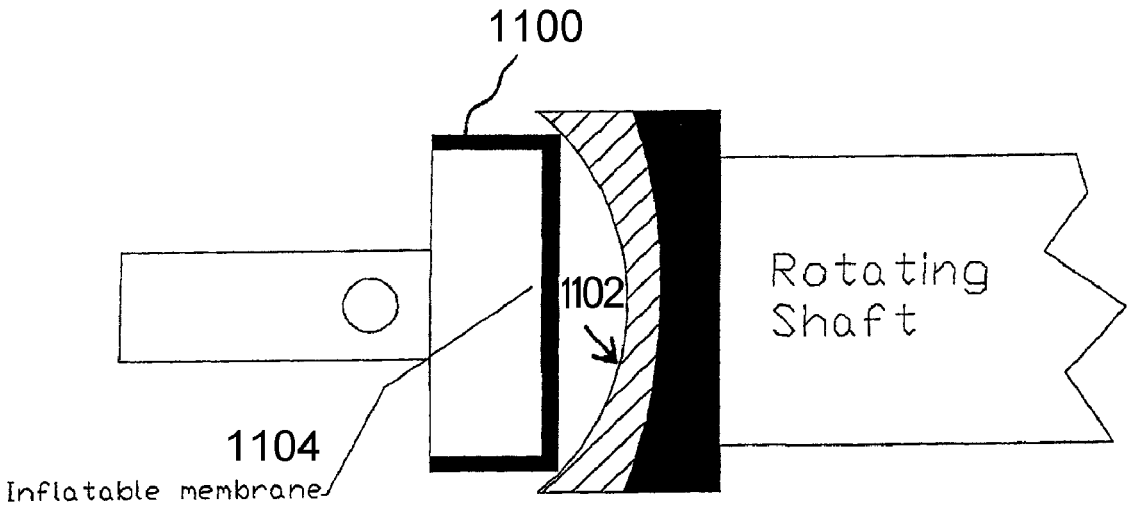
FIGS. 12-14 show schematic views of an exemplary embodiment of an inflatable membrane lapping tool.
Figure 13:
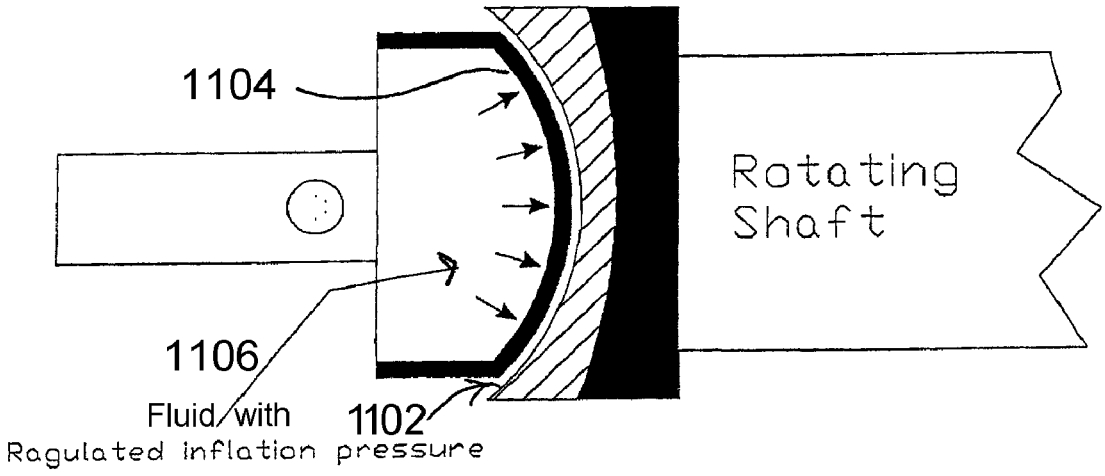

In addition to the previously described conformable lap tools, as shown in FIG. 12, exemplary embodiments may include a conformable lap tool 1100 that is operative to expand in size to a shape which corresponds to the lens 1102 surface to be polished. In this described exemplary embodiment the lap tool 1100 includes an elastic and inflatable membrane 1104. FIG. 38 shows the presentation of the inflatable membrane lapping tool 1100 to close proximity of the lens surface 1102. FIG. 13 illustrates the inflation of the membrane to conform to the lens surface. In an exemplary embodiment the system may include a pump that is operative to supply a gas or liquid fluid 1106 adjacent the inside of the membrane. The pump may be regulated to provide sufficient fluid pressure to ensure optimal and uniform lapping pressure with the membrane 1104. In an exemplary embodiment the fluid may be chilled to act as a cooling agent.

Figure 14:
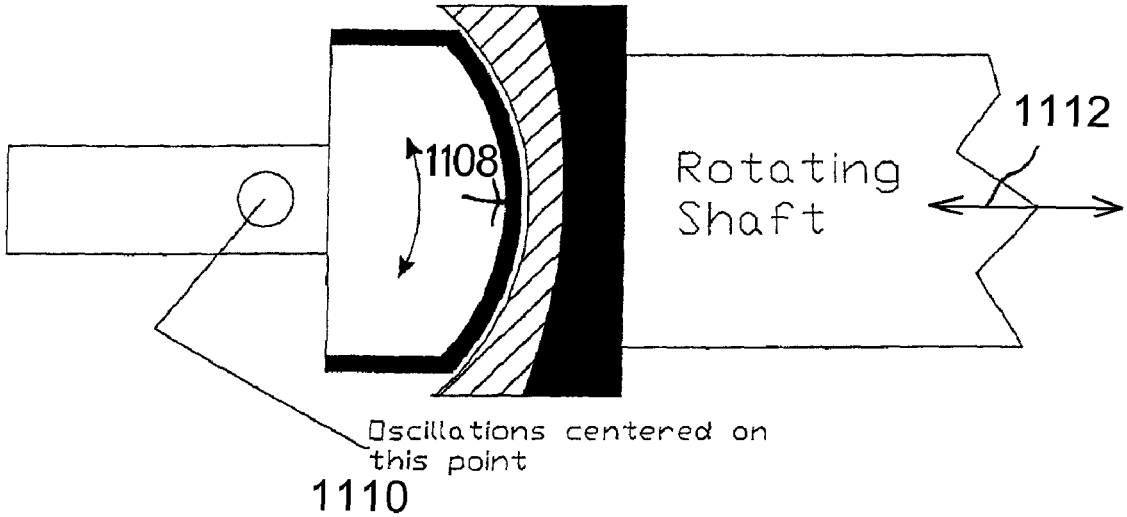

FIG. 14 shows the polishing head 1108 of the membrane oscillating about a point 1110 that represents the center of curvature of the lens surface that the lens possesses in the plane of oscillation. The pivoting point can be moved along a line parallel to the axis of rotation 1112 of the lens in order to regulate the radius of the arc that the polishing head moves along.

In order to achieve the degree of surface to surface randomness required to eliminate localized optical flaws arising from the small and often present irregularities in the lapping surface, the lens may be made to rotate and to dither along an axis perpendicular to the axis of rotation 1112 of the lens. This keeps any small localized flaws in the lapping surface from dwelling over a solitary locus of the lens causing an optical aberration, often called a "wave", at that location. In the exemplary embodiment, the polishing head 1108 may be motivated to oscillate so that the lapping surface traces the lens surface thereby minimizing the degree of re-conformation required of the conformable lapping surface.

Figure 15:
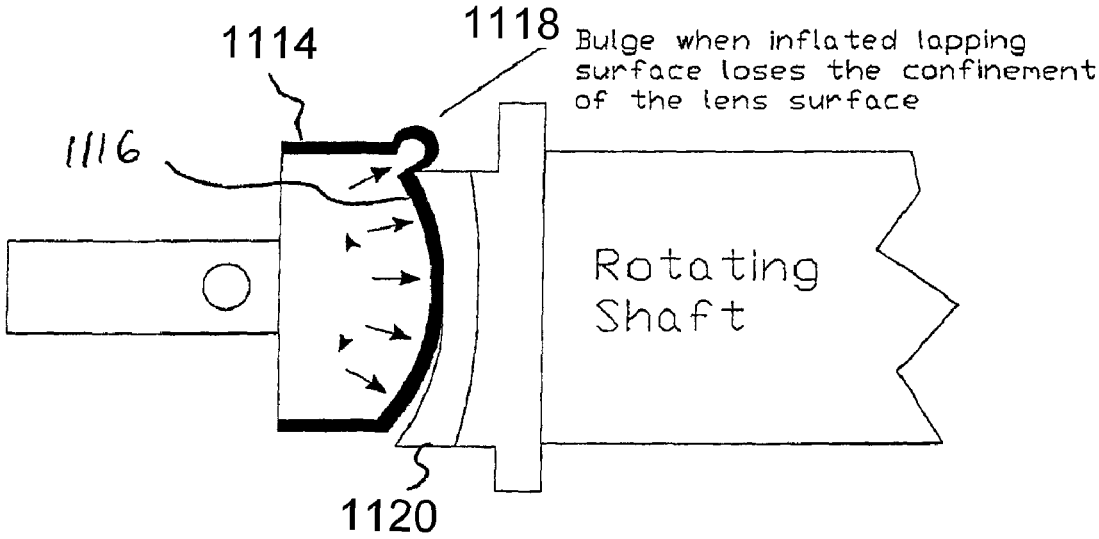
FIG. 15 shows a schematic views of an exemplary embodiment of an inflatable membrane lapping tool in which a bulge has formed adjacent a cribbed lens.

FIG. 15 shows an example of a loss of confinement of an inflatable sub-aperture lap tool 1114 when the tool becomes "supra-aperture" due to normal cribbing of the lens 1120. As discussed previously, the machining platform may be operative to crib the diameter of the lens blank down to the final lens dimensions. When an inflatable sub-aperture conformable polishing head 1116 of the lap tool escapes confinement by the lens surface with which it is in intimate pressurized contact, it will tend to bulge and lose its required shape. The bulge 1118 can become partially entrapped between the lens 1120 and the inflatable membrane support structure risking damage to the membrane and rendering the lap tool useless for the current cycle if not forever.

Figure 16:
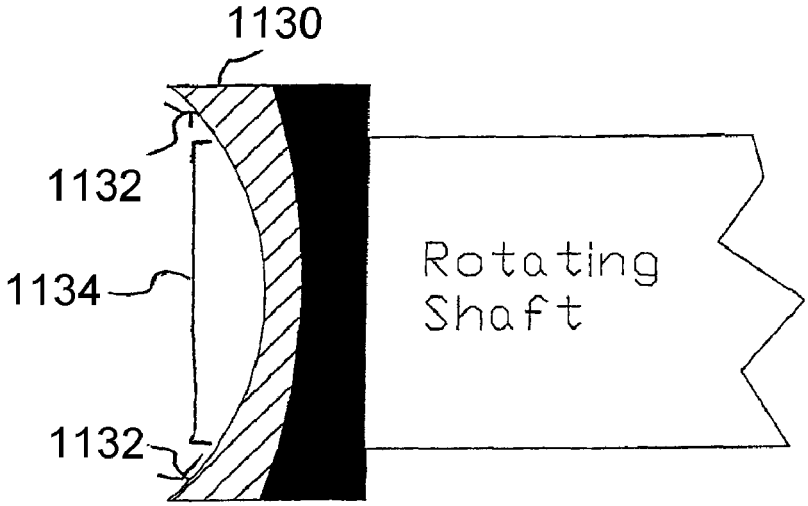
FIG. 16 shows a schematic view of an exemplary embodiment a lens blank in which the diameter of the lens blank has not been cribbed.

To prevent a conformable lap tool from bulging as shown in FIG. 15, an exemplary embodiment may forgo cribbing of the diameter of the lens blank prior to polishing the surface of the lens. An example of a lens 1130 which has not been cribbed prior to polishing is shown in FIG. 16. However cribbing is operative to minimize the surface area of the portion of the lens that requires fine lathing. Lathing the un-cribbed surfaces 1132 requires significantly more time than if confining the lathing only to the area 1134 of the lens that resides within the area that will become the finished lens. Also any extra lathing time adds to expensive diamond tool wear.

Figure 17:
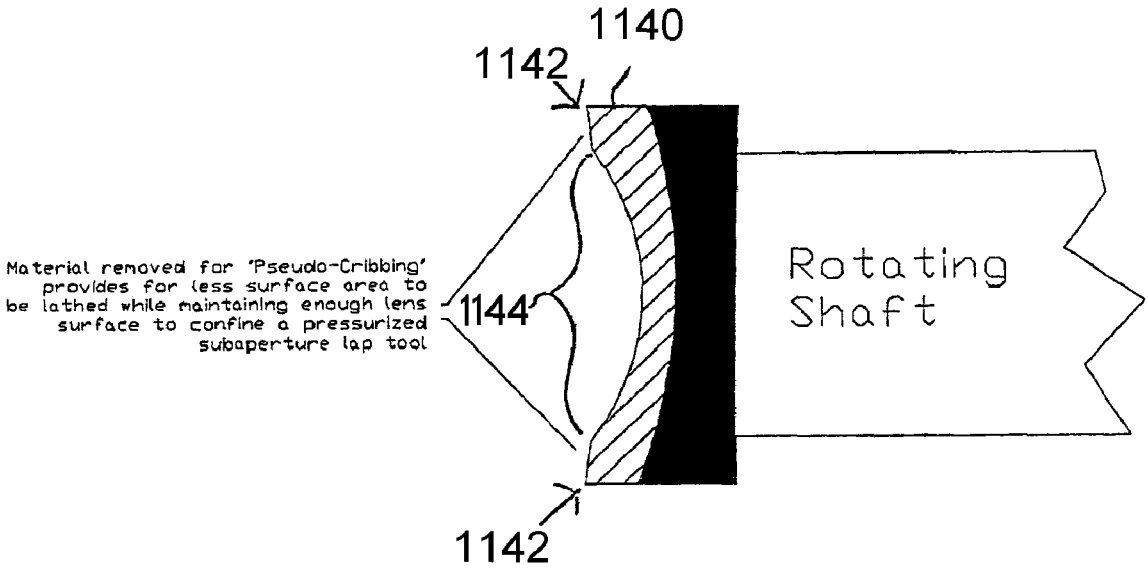
FIG. 17 shows a schematic view of an exemplary embodiment a lens blank in which the lens blank has undergone a "pseudo-cribbing" process.

A shown in FIG. 17, to both reduce lathing cycle times and prevent bulging of a conformable lap tool, the machining platform may perform a "pseudo-cribbing" step on the lens blank 1140 prior to lathing the surface of the lens blank. In FIG. 17 the amount of beveling is exaggerated for emphasis. In the exemplary embodiment the "pseudo-cribbing" is operative to both shorten lathing cycle times by reducing the amount of surface area that has to be lathed while also providing sufficient material at the edge of the lens blank to maintain confinement of an appropriate sub-aperture conformable lapping tool. In an exemplary embodiment the "pseudo-cribbing" step may take place during the rotary stage of the machining process in which a rotary cutting tool is used to perform rough surfacing of the back surface of the lens.

In this described exemplary embodiment, "pseudo-cribbing" corresponds to a machining process which reduces the thickness of the lens blank along the edge portions 1142 of the lens blank that will not remain after the lens 1144 is edged to fit within the lens receiving portion of a spectacle frame. Reducing the thickness of the lens blank at these edge portions 1142 reduces the amount of fine lathing required for the lens blank, while leaving the lens blank with a diameter that is sufficiently large relative the conformable lapping tool to prevent bulging of the conformable lapping tool.

Figure 18:
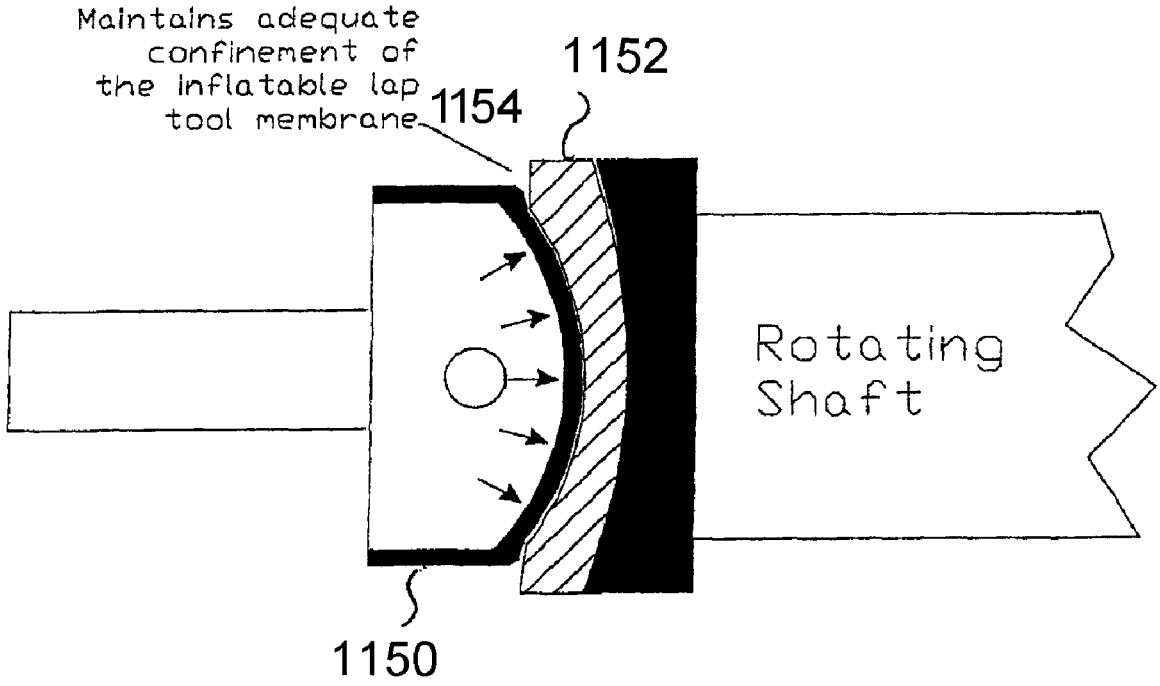
FIG. 18 shows a schematic views of an exemplary embodiment of an inflatable membrane lapping tool polishing a lens blank that has undergone a "pseudo-cribbing" stage.

FIG. 18 shows an example of an inflated lap tool 1150 in pressurized contact with a lens 1152 that has undergone "pseudo-cribbing". Material left by "pseudo-cribbing" at the edges 1154 of the lens provides for adequate confinement of the inflatable lapping membrane while minimizing the amount of surface that has to be surfaced by a fine lathing process.

Thus the system and method for ophthalmic lens manufacture achieves one or more of the above stated objectives, eliminates difficulties encountered in the use of prior devices and systems, solves problems and attains the desirable results described herein. In the foregoing description certain terms have been used for brevity, clarity and understanding, however no unnecessary limitations are to be implied there from because such terms are used for descriptive purposes and are intended to be broadly construed. Moreover, the descriptions and illustrations herein are by way of examples and the invention is not limited to the exact details shown and described.

Having described the features, discoveries and principles of the invention, the manner in which it is constructed and operated, and the advantages and useful results attained; the new and useful structures, devices, elements, arrangements, parts, combinations, systems, equipment, operations, methods and relationships are set forth in the appended claims. Whereas particular embodiments of this invention have been described above for purposes of illustration, it will be evident to those skilled in the art that numerous variations of the details of the present invention may be made without departing from the invention as defined in the appended claims.

What is claimed is:

1. A method comprising:

A) selecting a pre-blocked lens blank assembly responsive to an eyeglass prescription, wherein the pre-blocked lens blank assembly is comprised of a lens blank mounted to a block;

B) machining the lens blank responsive to the eyeglass prescription for a patient, wherein the machining of each lens blank includes machining a back surface of the lens blank responsive to data representative of an eyeglass prescription and edging of the lens blanks at the manufacturing site and wherein the edging of each lens blank includes machining an edge of the lens blank to include a contour adapted to be mounted in the lens receiving portion of an eyeglass frame responsive to data representative of the lens receiving portion;

C) prior to (A) and (B) mounting the lens blank to the block without knowledge of the eyeglass prescription for the patient.

2. The method according to claim 1, wherein (a) includes selecting the pre-blocked lens blank assembly responsive to the eyeglass prescription from an inventory comprised of plurality of sets of pre-blocked lens blank assemblies, wherein each respective set of assemblies includes lens blanks with different respective front surface topographies.

3. A method comprising:

a) through operation of at least one computer responsive to data representative of an eyeglass prescription for a patient, providing an output through an output device of the computer, which output prompts a user to select a pre-blocked lens blank assembly from an inventory comprised of a plurality of sets of pre-blocked lens blank assemblies, wherein each pre-blocked lens blank assembly is comprised of a lens blank mounted to a block, wherein each respective set of assemblies includes lens blanks with different respective front surface topographies;

b) through operation of at least one computer, causing a machining platform to machine the lens blank of the selected pre-blocked lens blank assembly responsive to data representative of the eyeglass prescription for the patient and responsive to data representative of a lens receiving portion of an eyeglass frame wherein machining of ophthalmic lens includes simultaneously machining left and right ophthalmic lens from the blocked lens blanks at the manufacturing site on the machining platform;

c) prior to (a) and (b) producing the selected pre-blocked lens blank assembly by mounting the lens blank to the block, wherein mounting the lens blank to the block is not carried out responsive to either data representative of the eyeglass prescription of the patient or data representative of the lens receiving portion of the eyeglass frame.

4. Method of manufacturing ophthalmic lens comprising the steps of:

a) mounting lens blanks on lens blocks at a blocking location;

b) transporting the blocked lens blanks to at least one manufacturing site that is remote from the blocking location; and c) selectively machining ophthalmic lens from the blocked lens blanks at the manufacturing site on a machining platform, wherein the selective machining of ophthalmic lens includes back surface generation of the lens blanks and wherein the machining of each lens blank includes machining a back surface of the lens blank responsive to data representative of an eyeglass prescription and edging of the lens blanks at the manufacturing site and wherein the edging of each lens blank includes machining an edge of the lens blank to include a contour adapted to be mounted in the lens receiving portion of an eyeglass frame responsive to data representative of the lens receiving portion.

5. The method of manufacturing ophthalmic lens according to claim 4 wherein the selective machining of ophthalmic lens includes simultaneously machining left and right ophthalmic lens from the blocked lens blanks at the manufacturing site on the machining platform.

6. The method of manufacturing ophthalmic lens according to claim 4 wherein each lens blanks remains blocked throughout the back surface generation and the edging of the lens blanks.

7. The method of manufacturing ophthalmic lens according to claim 4 wherein the lens blanks are mounted on the lens blocks at the blocking location without regard to specific lens prescription data.

8. The method of manufacturing ophthalmic lens according to claim 4 further including the steps of:

d) mounting additional lens blanks on additional lens blocks at the blocking location; and e) selectively machining specialized ophthalmic lens from the additional blocked lens blanks at the blocking location on a machining platform, wherein the specialized ophthalmic lens are unsuitable to be machined from the blocked lens blanks at the manufacturing site.

9. The method of manufacturing ophthalmic lens according to claim 4 wherein the blocked lens blanks will be transported to a plurality of manufacturing locations from a single blocking location.

10. The method of manufacturing ophthalmic lens according to claim 4 wherein the machining platform at each manufacturing location occupies less than about fifteen square feet.

11. The method of manufacturing ophthalmic lens according to claim 4 wherein the blocked lens blanks includes identifying indicia indicative of a species of lens that may be machined from the blocked lens blank.

12. The method of manufacturing ophthalmic lens according to claim 11 wherein the identifying indicia includes one of a bar code, an alphanumeric printed code, color coding, and combinations thereof.

13. Method of manufacturing ophthalmic lens comprising the steps of:

a) mounting lens blanks on lens blocks without regard to specific lens prescription data; and b) selectively machining ophthalmic lens from the blocked lens blanks on a single machining platform and wherein the selective machining of ophthalmic lens includes simultaneously machining left and right ophthalmic lens from the blocked lens blanks at the manufacturing site on the machining platform.

14. The method of manufacturing ophthalmic lens according to claim 13 wherein the mounting of the lens blanks on the lens blocks is at a blocking location and further including the step of transporting the blocked lens blanks to at least one manufacturing site that is remote from the blocking location, and wherein the selective machining of the ophthalmic lens from the blocked lens blanks is at the manufacturing site on the machining platform.

* * * * *